US009257739B2

(12) United States Patent
Takatsuka et al.

(10) Patent No.: US 9,257,739 B2
(45) Date of Patent: Feb. 9, 2016

(54) ANTENNA DEVICE AND COMMUNICATION APPARATUS

(75) Inventors: Susumu Takatsuka, Tokyo (JP); Shin Takanashi, Kanagawa (JP); Tetsuya Naruse, Kanagawa (JP); Takeshi Sawada, Tokyo (JP)

(73) Assignees: SONY CORPORATION, Tokyo (JP); SONY MOBILE COMMUNICATIONS, INC., Tokyo (JP)

( * ) Notice: Subject to any disclaimer, the term of this patent is extended or adjusted under 35 U.S.C. 154(b) by 1010 days.

(21) Appl. No.: 12/868,968

(22) Filed: Aug. 26, 2010

(65) Prior Publication Data

US 2011/0134004 A1 Jun. 9, 2011

(30) Foreign Application Priority Data

Dec. 9, 2009 (JP) ..... P2009-279274

(51) Int. Cl.

| | |
|---|---|
| ***H01Q 3/00*** | (2006.01) |
| ***H01Q 1/24*** | (2006.01) |
| ***H01Q 1/12*** | (2006.01) |
| ***H01Q 1/20*** | (2006.01) |
| ***H01Q 3/08*** | (2006.01) |

(52) U.S. Cl.

CPC ..... *H01Q 1/245* (2013.01); *H01Q 1/1264* (2013.01); *H01Q 1/20* (2013.01); *H01Q 3/08* (2013.01)

(58) Field of Classification Search

USPC ..... 343/757, 703, 900, 702

See application file for complete search history.

(56) References Cited

U.S. PATENT DOCUMENTS

| | | | | |
|---|---|---|---|---|
| 5,835,070 | A * | 11/1998 | Scaraglino | H01Q 1/087 343/856 |
| 6,662,021 | B2 * | 12/2003 | Kang | H01Q 1/243 343/895 |
| 7,602,098 | B2 * | 10/2009 | Ide | H02N 11/006 310/300 |
| 2004/0189543 | A1 * | 9/2004 | Jordan | H01Q 1/085 343/900 |
| 2008/0297107 | A1 * | 12/2008 | Kato | H01F 27/2871 320/108 |
| 2008/0316109 | A1 * | 12/2008 | Savolainen | H01Q 1/2283 343/700 MS |

FOREIGN PATENT DOCUMENTS

| | | |
|---|---|---|
| JP | 7 147508 | 6/1995 |
| JP | 2005 167829 | 6/2005 |

* cited by examiner

*Primary Examiner* — Hoang V Nguyen
*Assistant Examiner* — Hai Tran
(74) *Attorney, Agent, or Firm* — Frommer Lawrence & Haug LLP; William S. Frommer

(57) ABSTRACT

An antenna device includes: a line-shaped antenna conductor with a predetermined length; an actuator member that directly supports the line-shaped antenna or supports the line-shaped antenna via an auxiliary member and is displaceable integrally with the antenna conductor, where the actuator member is displaced to change a position of the antenna conductor in a space; and an attaching member that attaches the actuator member and the antenna member in one longitudinal end of the antenna conductor to a communication apparatus. The actuator member performs displacement control in which one longitudinal end of the antenna conductor serves as a fixed support and the other end thereof serves as a free end to be displaceable depending on the control voltage.

12 Claims, 19 Drawing Sheets

| POSITION | INCREASED/ DECREASED STEP VOLTAGE | Vx | Vy |
|---|---|---|---|
| 0 | | 0 | 0 |
| 1 | +ΔVy | 0 | +ΔVy |
| 2 | +ΔVx | +ΔVx | +ΔVy |
| 3 | −ΔVy | +ΔVx | 0 |
| 4 | −ΔVy | +ΔVx | −ΔVy |
| 5 | −ΔVx | 0 | −ΔVy |
| 6 | −ΔVx | −ΔVx | −ΔVy |
| 7 | +ΔVy | −ΔVx | 0 |
| 8 | +ΔVy | −ΔVx | +ΔVy |
| 9 | +ΔVy | −ΔVx | +2ΔVy |
| | | | |

| POSITION | INCREASED/ DECREASED STEP VOLTAGE | Vx | Vy |
|---|---|---|---|
| 0 | | +ΔVx | +ΔVy |
| 1 | +ΔVy | +ΔVx | +2ΔVy |
| 2 | +ΔVx | +2ΔVx | +2ΔVy |
| 3 | −ΔVy | +2ΔVx | +ΔVy |
| 4 | −ΔVy | +2ΔVx | 0 |
| 5 | −ΔVx | +ΔVx | 0 |
| 6 | −ΔVx | 0 | 0 |
| 7 | +ΔVy | 0 | +ΔVy |
| 8 | +ΔVy | 0 | +2ΔVy |
| 9 | +ΔVy | 0 | +3ΔVy |
| | | | |

FIG. 16

| TABLE IDENTIFIER | Vx | Vy |
|---|---|---|
| A | VxA | VyA |
| B | VxB | VyB |
| ⋮ | ⋮ | ⋮ |
| N | VxN | VyN |

ANTENNA DEVICE AND COMMUNICATION APPARATUS

BACKGROUND OF THE INVENTION

1. Field of the Invention

The present invention relates to an antenna device suitably applicable to a communication device, such as a cellular phone terminal, and also relates to a communication device equipped with this antenna device.

2. Description of the Related Art

A handheld communication device, such as a cellular phone terminal, is designed to be easily carried or moved, so that the whole size thereof including an antenna unit is smaller the better. It is also preferable that the antenna is unobstructable.

Therefore, as disclosed in Japanese Patent Laid-Open No. 2005-167829 (Patent document 1) for example, a handheld communication terminal having a strap-shaped antenna device unit has been proposed in the art. In the patent document 1, the antenna deice unit includes an antenna member in which an antenna conductor is formed on a flexible substrate. Such an antenna device can be attached as a strap to the handheld communication terminal.

Therefore, the antenna device unit can stand clear of the handheld communication terminal and does not disfigure the handheld communication terminal.

In addition, Japanese Patent Laid-Open No. 7-147508 (Patent document 2) discloses an antenna for communication apparatus using an antenna member made of shape memory alloy. In other words, the antenna disclosed in Patent document 2 houses an antenna member in the housing of the communication member as far as possible at the time of out-of communication (nonuse). Alternatively, at the time of communication, the shape memory alloy that forms the antenna member is heated to raise the antenna so as to extend the antenna toward the outside of the housing.

Therefore, according to Patent document 2, it is convenient that the antenna is in a state of being housed at the time of out-of communication without hindrance. At the time of communication, the antenna is automatically raised to enhance the reception sensitivity.

SUMMARY OF THE INVENTION

However, in the antenna device of Patent document 1, there is a disadvantage in that it is difficult to retain an increase in reception sensitivity, retain the direction of reception, and make the state of being appropriate the reception.

In the case of the antenna device according to Patent document 2, such a disadvantage can be prevented. However, there is another problem in that the use of the shape memory alloy leads to returning to only a certain state, small flexibility, and a difficulty in fine adjustment of reception sensitivity, a difficulty of fine adjustment of reception sensitivity.

According to any embodiment of the present invention, in consideration of the aforementioned description, an antenna device and a communication apparatus, which can be automatically adjusted to a state suitable for reception during a communication period, have been desired.

In order to overcome the aforementioned disadvantage, an embodiment of the present invention is an antenna device including: a line-shaped antenna conductor with a predetermined length; an actuator member that directly supports the line-shaped antenna or supports the line-shaped antenna via an auxiliary member and is displaceable integrally with the antenna conductor, where the actuator member is displaced to change a position of the antenna conductor in a space, and an attaching member that attaches the actuator member and the antenna member in one end of the antenna conductor to a communication apparatus. The actuator member performs displacement control in which the antenna conductor is displaceable in at leas one plane including the center line of the linear antenna conductor depending on the control voltage while one end of the antenna conductor serves as a fixed support.

According to the configuration of the antenna device of the present embodiment, the linear antenna conductor is designed to be controllably displaced by the actuator member. Thus, the antenna device is in an unobstructed state during a non-communication period. During a communication period, a control voltage is applied to the actuator member to adjust the antenna device to be suitable for automatic reception.

According to another embodiment of the present invention, there is provided a communication apparatus including: a housing including a communication circuit and a control circuit; and an antenna device having an antenna conductor on the outside of the housing. The antenna device includes the antenna conductor having a linear shape with a predetermined length, an actuator member that directly supports the line-shaped antenna or supports the line-shaped antenna via an auxiliary member and is displaceable integrally with the antenna conductor, where the actuator member is displaced to change a position of the antenna conductor in a space, and an attaching member that attaches the actuator member and the antenna member in one end of the antenna conductor to a communication apparatus, the control circuit includes a detection means that detects the strength of electromagnetic waves received through the antenna conductor, and an actuator-driving control means generates the control voltage depending on the strength of the electromagnetic waves detected by the strength detection means, supplies the generated control voltage to the actuator member, and controls displacement of the actuator member so that the antenna conductor is brought to a position with a high reception sensitivity.

In the communication apparatus according to the embodiment of the present invention, the linear antenna conductor is controllably displaced by the actuator member, so that it is in an unobstructed state during a non-communication period. In addition, during a communication period, a control voltage depending on the strength of electromagnetic waves is supplied to the actuator member, so that the antenna conductor is brought to a position with high reception sensitivity.

Another embodiment of the present invention is a communication apparatus including: a housing including a communication circuit and a control circuit; and an antenna device having an antenna conductor on the outside of the housing, the communication apparatus is held near the user's head to execute a communication function. The antenna device includes the antenna conductor having a linear shape with a predetermined length, an actuator member that directly supports the line-shaped antenna or supports the line-shaped antenna via an auxiliary member and is displaceable integrally with the antenna conductor, where the actuator member is displaced to change a position of the antenna conductor in a space, and an attaching member that attaches the actuator member and the antenna member in one end of the antenna conductor to a communication apparatus, the control circuit includes a communication-state detection means that detects when the communication function is executed, and an actuator-driving control means, when the communication-state detection means detects when the communication is executed. The control voltage that keeps the antenna conductor away from the head of the user is generated so as to satisfy the criteria of the electromagnetic waves acceptable to the human body in a state of being held near the user's head, and supplies the generated control voltage to the actuator member.

In the communication apparatus according to the embodiment of the present invention, the linear antenna conductor is controllably displaced by the actuator member, so that it is in an unobstructed state during a non-communication period. During a communication period, a control voltage which keeps the antenna conductor away from the head of the user is supplied to the antenna conductor to automatically satisfy the criteria of the electromagnetic waves acceptable to the human body in a state of being held near the user's head.

According to any embodiment of the present invention, an antenna deice and a communication apparatus, which can be automatically adjusted to a state suitable for reception during a communication period.

BRIEF DESCRIPTION OF THE DRAWINGS

FIG. 16 is a diagram illustrating another exemplary processing of displacement control on the antenna conductor in the antenna device according to the embodiment of the present invention;

DESCRIPTION OF THE PREFERRED EMBODIMENTS

Hereinafter, an antenna device according to an embodiment of the present invention and a communication apparatus according to another embodiment of the present invention, which is provided with such an antenna device, will be described with reference to the attached drawings.

Here, a cellar phone terminal will be described as an example of the communication apparatus of the embodiment.

In a typical cellular phone terminal, a received voice is heard through a receiver (loudspeaker) in the housing of the cellular phone terminal, so that the user holds the housing near the ear of the head.

By the way, in consideration of an influence of electromagnetic waves on the human body, the criteria for allowable electromagnetic waves for the human body have been established from 1997. As an index for criterion for allowable electromagnetic field on the human body, a specific absorption rate (SAR) has been presently used. The SAR is the amount of energy absorbed into the unit mass of the tissue per unit mass. The SAR reveals the amount of energy the human body has received within a certain time from an apparatus that emits a certain electric wave.

The unit of SAR is watts per kilogram (W/Kg). In other words, the SAR is represented by a unit of how many watts (W) is the thermal energy absorbed per kilogram (Kg). The more the level of SAR increases, the more the human body is affected.

A "whole-body average SAR" and a "local SAR" have been defined as criterion for electromagnetic waves acceptable to the human body. Cellular phone terminals use the "local SAR" because of an adverse effect of a communication apparatus to be used near the head of the human body.

In the communication apparatus of the present embodiment, as described below, the spatial position of an antenna device can be changed under control. In consideration of influences of electromagnetic waves on the human body as mentioned above, the configuration of the cellular phone terminal of this embodiment allows the antenna device to be placed under an appropriate reception condition while satisfying the criterion of electromagnetic waves acceptable to the human body.

Figure 2:
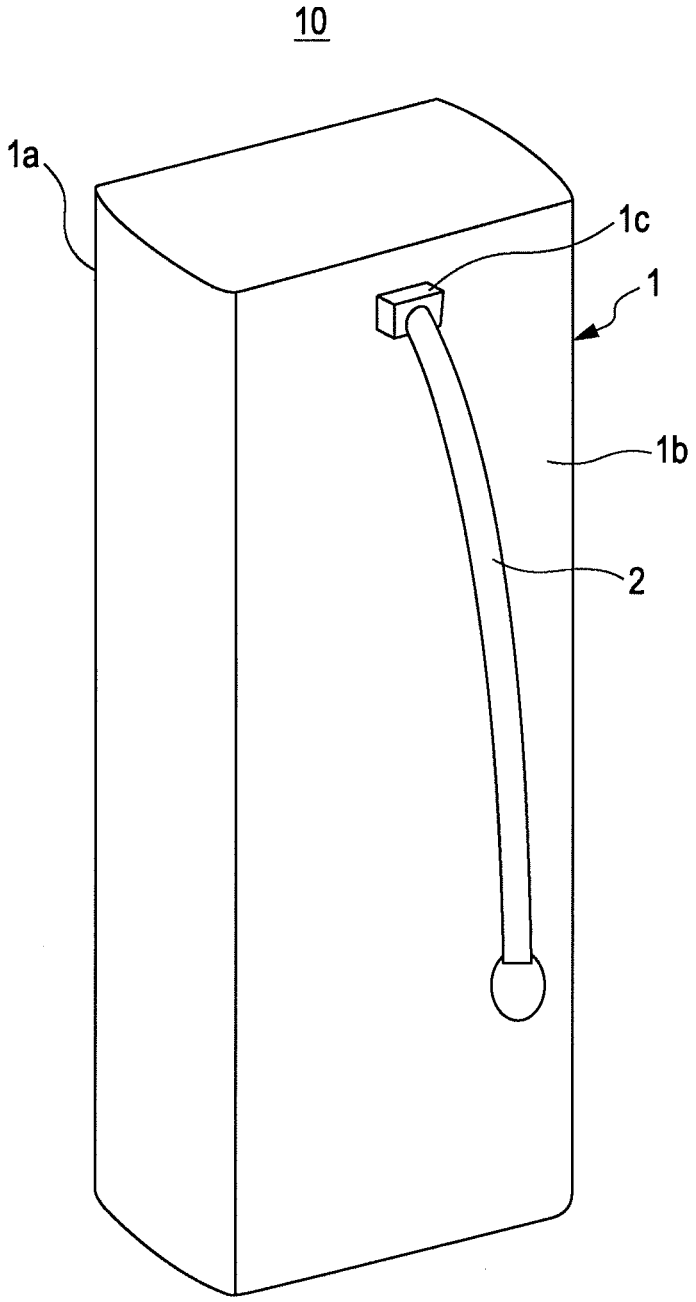
FIG. 2 is a diagram illustrating an external view of a cellular phone terminal as a communication system according to the embodiment of the present invention.

FIG. 2 is a diagram illustrating the appearance of a cellular phone terminal 10 of the present embodiment. As shown in the figure, the cellular phone terminal 10 of the present embodiment includes a generally rectangular housing 1 with a narrow width on which a linear antenna device 2 is attached.

In this embodiment, as shown in FIG. 2, the linear antenna device 2 is mounted on the side 1*b* of the housing 1, which is opposite to the side 1*a* thereof where the sound-emitting opening of the receiver speaker in the housing 1. The user directs the side 1*b* of the housing outward but not to the head when the user holds the cellular phone terminal 10 in his/her hand and places the housing 1 near the ear of the head.

Furthermore, the linear antenna device 2 is attached like a strap to the housing 1. That is, one end of the linear antenna device 2 is attached to and fixed on an attaching portion 1*c* formed on the longitudinal end portion of the surface 1*b* of the rectangular housing 1. Furthermore, on the opposite end portion of the surface 1*a* of the housing 1 from the attaching portion 1*c* of the surface 1*b*, the sound-generating opening of the receiver speaker is formed.

Here, in this embodiment, the attaching portion 1*c* is located almost on the center in the narrow side direction of the surface 1*b*. In addition, the attaching portion 1*c* is formed so that the longitudinal direction of the linear antenna device 1 can be perpendicular to the surface 1*b* of the housing 1.

Therefore, when talking over the cellular phone terminal 10 by holding it in hand and keeping the housing 1 thereof near the ear of the head, the electromagnetic waves from the antenna device 2 can be prevented from directly entering into the head of the user because of the presence of the housing 1 between the antenna device 2 and the head of the user. However, if the housing 1 is miniaturized, the presence of the housing 1 is not sufficient to satisfy the criteria for the electromagnetic waves allowable to the human body with respect to those emitted from the linear antenna device 2. In this embodiment, therefore, at the time of a telephone conversation based on calling and incoming on the cellular phone terminal 10, the antenna device 2 is allowed to change its position to satisfy the criterion of the electromagnetic waves acceptable to the human body.

<Configuration of Antenna Device 2 According to Embodiment>

Referring now to FIG. 1, an exemplary configuration of the antenna device 2 according to the embodiment will be described.

Figure 1A:
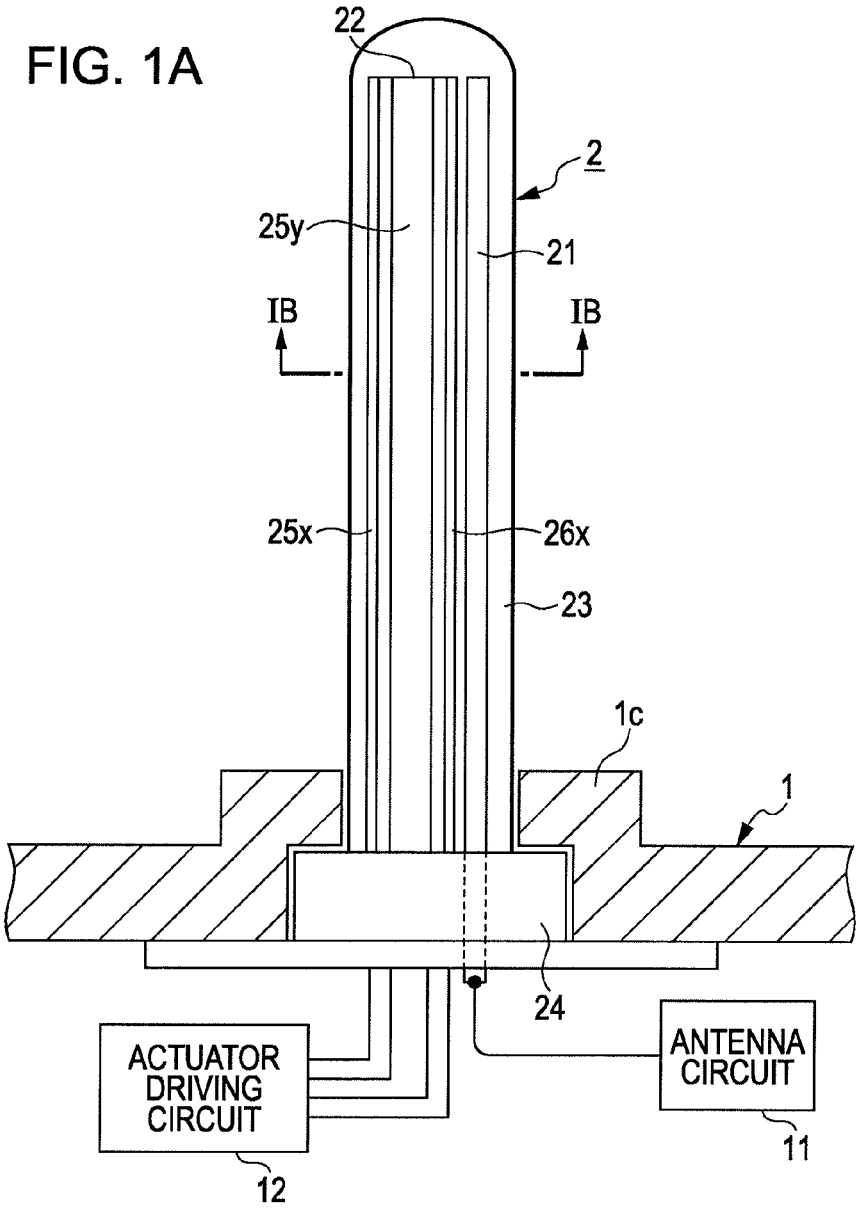
FIG. 1 is a diagram illustrating the configuration of an antenna device according to an embodiment of the present invention.
Figure 1B:
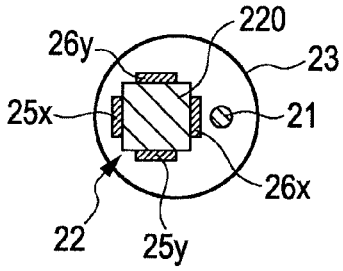

FIG. 1A is a diagram illustrating the antenna device 2 and the attaching portion 1*c* of the housing 1 of the cellular phone terminal 10 and also illustrating the circuit part in the housing 1 with respect to the antenna device 2. In addition, FIG. 1B is a cross-sectional diagram of the linear part of the antenna device 2 along the line IB-IB in FIG. 1A.

As shown in FIG. 1, the antenna device 2 of the present embodiment includes an antenna conductor 21, an actuator member 22, a cover 23, and an attaching member 24.

In this embodiment, as shown in FIG. 1, the antenna device 2 is constructed as a linear structure as a whole such that the linear antenna conductor 21 and the linear actuator member 22 are electrically separated from each other while being covered with the cover 23 in a unified manner. Therefore, the antenna device 2 is designed so that the cover 23, which is an exemplary auxiliary member, allows the antenna conductor 2 and the actuator member 22 to be integrally displaced.

The longitudinal end of the linear antenna device 2 is attached to and fixed on the attaching member 24. Then, the one end of the antenna device 2 is attached like a strap to the housing 1 and fixed thereon by adhesion, screw clamp, or the like of the attaching member 24 to the attaching portion 11*c* of the housing 1 from the inside of the housing 1.

The antenna conductor 21 is a linear flexible conductor having a length suitable for an antenna conductor of the cellular phone terminal 1. One end of the antenna conductor 21 is introduced into the housing 1 of the cellular phone terminal 10 through the attaching member 24 and connected to an antenna circuit 11.

The antenna circuit 11 extracts a received signal from received electromagnetic waves received by the antenna conductor 21 and then supplies the received signal while supplying a transmission signal from the transmission signal generating unit (not shown) to the antenna conductor 21.

In this example, the actuator member 22 is a linear member having the same length as that of the antenna conductor 21 and placed along the antenna conductor 21. The actuator member 22 includes an ion conductive polymer streak 220 using ion-exchange region as a raw material. In other words, in this example, the actuator member 22 is a polymer actuator (ion conductive actuator).

Furthermore, in this embodiment, as shown in FIG. 1B, the ion conductive polymer streak 220 is in the shape of a square pole of a square in cross section. Four electrodes 25*x*, 25*y*, 26*x*, and 26*y* are formed on four lateral sides of the ion conductive polymer streak 220, respectively, with insulation. In this case, each of these four electrodes 25*x*, 25*y*, 26*x*, and 26*y* is formed over the whole area of the corresponding side of the other end of the ion conductive polymer streak 220 along the one end to the other end thereof in the longitudinal direction by deposition coating or the like.

The housing 1 includes an actuator driving circuit 12 from which an actuator-driving control voltage is supplied to the actuator member 22. In this example, the actuator-driving control voltage is a direct-current (DC) voltage.

Figure 3:
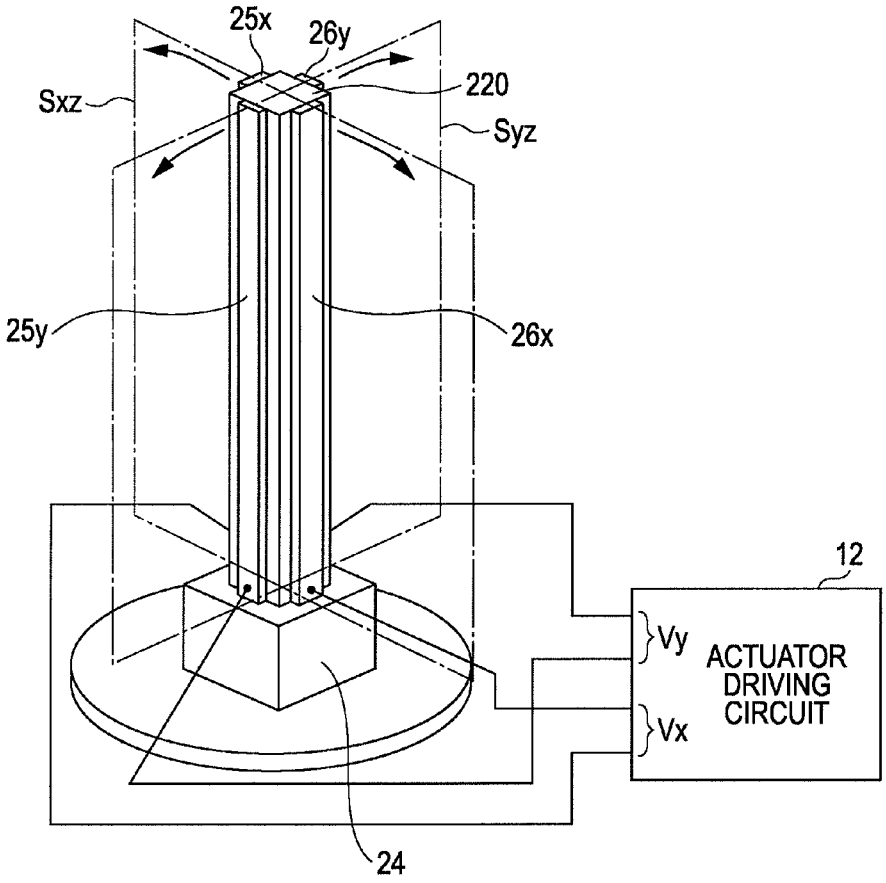
FIG. 3 is a diagram illustrating the displacement control of an antenna conductor of the antenna device according to the embodiment of the present invention.

In this example, as shown in FIG. 3, the electrodes 25*x* and 26*x* which face to each other are provided as first paired electrodes. A first actuator-driving control voltage Vx is supplied from the actuator-driving circuit 12 to the first paired electrodes 25*x* and 26*x*.

As shown in FIG. 3, furthermore, the electrodes 25*y* and 26*y* which face to each other are provided as second paired electrodes 25*y* and 26*y*. A second actuator-driving control voltage Vy is supplied from the actuator-driving circuit 12 to the second paired electrodes 25*y* and 26*y*.

In this case, the side of the ion conductive polymer streak 220 on which the electrodes 25*x* and 26*x* of the ion conductive polymer streak 220 are formed is perpendicular to one on which the electrodes 25*y* and 26*y* of the ion conductive polymer streak 220 are formed. Thus, the voltage-applying direction (electric field direction) of the DC voltage Vx is perpendicular to that of the DC voltage Vy.

The actuator member 22 undergoes displacement (deformation) depending on the polarity and the level of each of the first and second actuator-driving control voltages Vx and Vy. Hereinafter, the displacement principle of the actuator member 22 will be described. The details of the ion conductive actuator will be found in the web site at the address http://www.eamex.co.jp/ion.html.

The ion conductive polymer streak 220 in this example has almost the same hardness as that of the muscle of the living body and is made of a flexible material. As shown in FIG. 4, the ion conductive polymer streak 220 undergoes displacement (deformation) under application of DC voltage between two electrodes facing to each other, where the streak 220 is sandwiched between the electrodes.

Figure 4C:
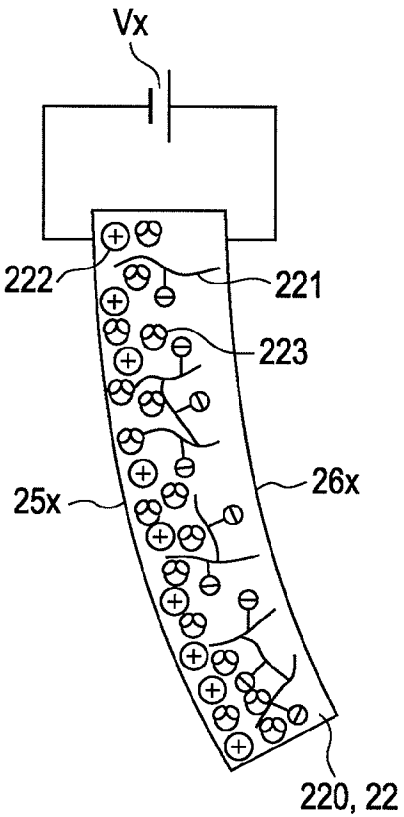
FIG. 4 is a diagram illustrating the displacement control of an antenna conductor of the antenna device according to the embodiment of the present invention.
Figure 4B:
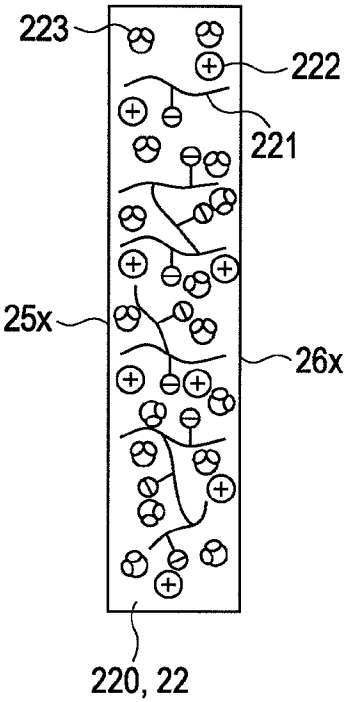
Figure 4A:
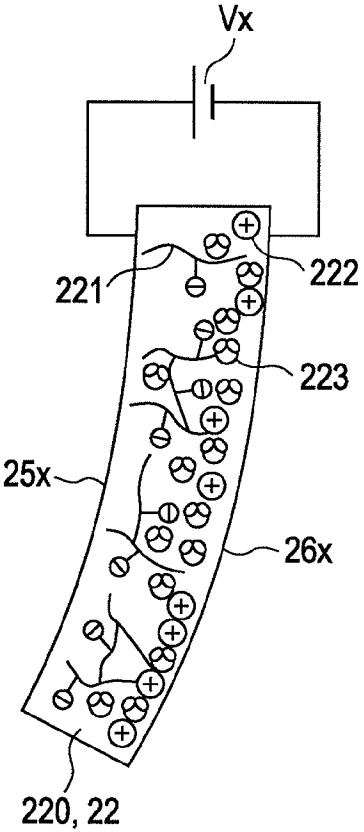

FIGS. 4A to 4C illustrate the displacement states of the ion conductive polymer streak 220 when the actuator-driving control voltage is applied between two electrodes 25*x* and 26*x*. In other words, as shown in FIG. 4, the ion conductive polymer streak 220 of this example is prepared by filling an ion exchange resin 221 with cations 222 and polar molecules 223.

In the state that a voltage is not applied between the electrodes 24 and 25, the ion conductive polymer streak 220 of this example, or the actuator member 22, can behave like a typical strap as it becomes being bent depending on the gravity or an external force applied by the user.

In this embodiment, the actuator-driving control voltage from the actuator driving circuit 12 is designed to be supplied to the actuator member 22 when the cellular phone terminal 1 sends or receives a message. Therefore, when the cellular phone terminal 1 is not in a communication state, the actuator member 22 can be bent freely by an external force in a manner similar to the typical strap. In this case, however, the electrode of the ion conductive polymer streak 220 generates an electromotive force in response to the degree of the bending. As shown in FIG. 4B, if the applied voltage between the electrodes 25*x* and 26*x* is zero, then the cations 222 and the polar molecules 223 are dispersed without deviating to any of these electrodes. Thus, the ion conductive polymer streak 220, or the actuator member 22, can keep its straightened state.

Here, in this specification, the longitudinal direction of the actuator member 22 in a straitened state refers to the z direction among three dimensional directions, x, y, and z, which are perpendicular to one another.

Next, as shown in FIG. 4A, when a DC voltage Vx is applied between the electrodes 25*x* and 26*x*, where the electrode 25*x* serves as a positive electrode (anode) and the electrode 26*x* serves as a negative electrode (cathode), cation ions 222 and polar molecules 223 move toward the cathode, the electrode 26*x*. Then, the electrode 25*x* side and the electrode 26*x* side of the ion conductive polymer streak 220 show a difference in swelling, so that the electrode 26*x* side extends and the electrode 25*x* side shrinks. As a result, the ion conductive polymer streak 220, or the actuator member 22 is deformed (displaced) so that the free end side thereof is curved to the electrode 25*x* with reference to the fixed end thereof.

In contrast, as shown in FIG. 4C, when a DC voltage Vx is applied between the electrodes 25*x* and 26*x*, where the electrode 25*x* serves as a negative electrode (cathode) and the electrode 26*x* serves as a positive electrode (anode), cation ions 222 and polar molecules 223 move toward the cathode, the electrode 26*x*. Then, the electrode 25*x* side and the electrode 26*x* side of the ion conductive polymer streak 220 show a difference in swelling, so that the electrode 26*x* side shrinks and the electrode 25*x* side extends. As a result, the ion conductive polymer streak 220, or the actuator member 22 is deformed (displaced) so that the free end side thereof is curved to the electrode 26*x* with reference to the fixed end thereof.

Depending on the level of the applied DC voltage, as described above, the actuator member 22, or the ion conductive polymer streak 220, can be deformed (displaced) within a plane including the direction of applying the DC voltage (the direction of electric field).

Here, in this specification, the direction along which the actuator member 22 is displaced by the voltage Vx applied between the electrode 25*x* and the electrode 26*x* refers to the x direction among three dimensional directions, x, y, and z, which are perpendicular to one another. Therefore, the voltage Vx applied between the electrode 25*x* and the electrode 26*x* deforms (displaces) the actuator member 22 within the plane Sxz including the z direction and the x direction as shown in FIG. 3 depending on the polarity and level of the voltage Vx.

In this example, as described above, two pairs, the paired electrodes 25*x* and 26*x* and the paired electrodes 25*y* and 26*y*, are entirely formed from the one end to the other end of the ion conductive polymer streak 220 in the longitudinal direction thereof.

Then, as represented in FIG. 3 described above, a first actuator-driving control voltage Vx is applied to the paired electrodes 25*x* and 26*x* and a second actuator-driving voltage Vy is applied to the paired electrode 25*y* and 26*y*.

As described above, depending on the level of the applied DC voltage, as described above, the actuator member 22, or the ion conductive polymer streak 220, can be deformed (displaced) within a plane including the direction of applying the DC voltage (the direction of electric field). The ion conductive polymer streak 220 can be displaced within the plane including the direction of applying the voltage Vy.

Here, in this specification, the direction along which the actuator member 22 is displaced by the voltage Vy applied between the electrode 25*y* and the electrode 26*y* refers to the y direction among three dimensional directions, x, y, and z, which are perpendicular to one another.

Figure 5:
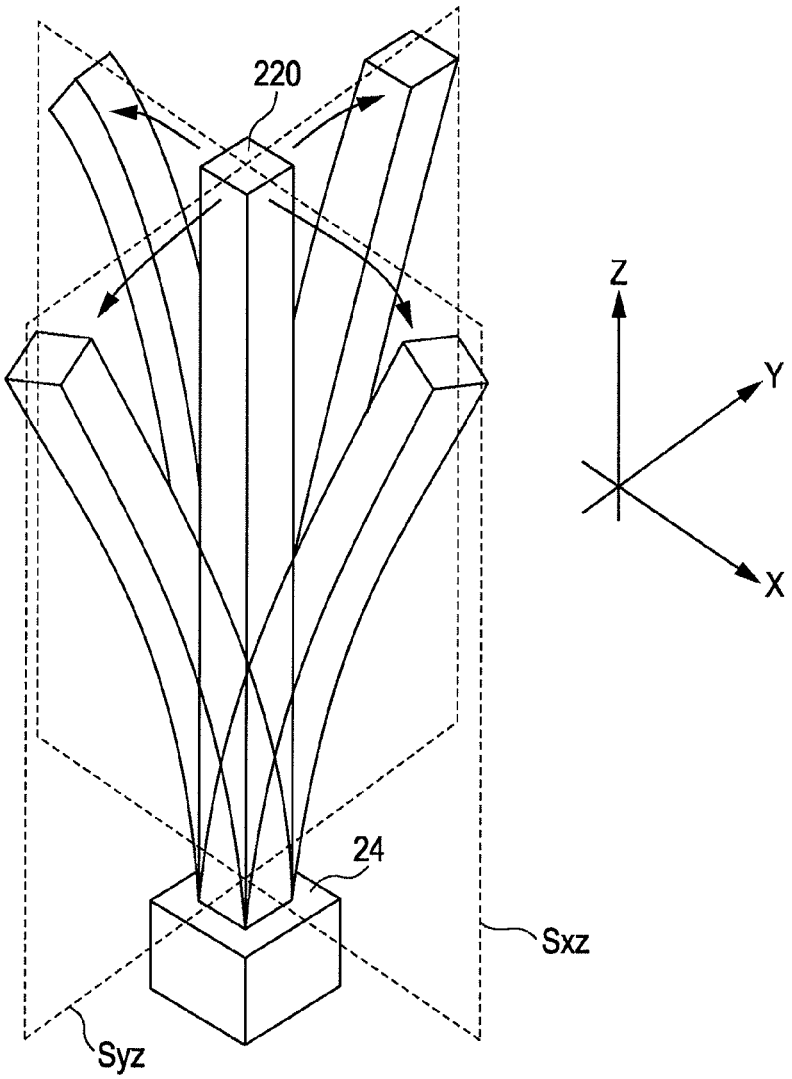
FIG. 5 is a diagram illustrating the displacement control of an antenna conductor of the antenna device according to the embodiment of the present invention.

In this embodiment, therefore, as shown in FIG. 3, the actuator-driving control voltage Vy allows the ion conductive polymer streak 220 to be deformed (displaced) depending on the plurality and level of the voltage Vy within the plane Syz including the direction of applying the DV voltage (the direction of electric field) (the plane including the z direction and the y direction). As a result, as shown in FIG. 5, the ion conductive high polymer streak 220 carries out independent deformation (displacement) in the planes Sxz and Syz independently by simultaneous application of two different actuator-driving control voltages Vx and Vy, respectively. Furthermore, the ion conductive polymer streak 220 carries out actual deformation (displacement) as a result of combining two kinds of the independent deformation (displacement) in the plane Sxz and the plane Syz.

In other words, the actuator member 22 can realize any level of deformation (displacement) in any direction in a space defined by two planes Sxz and Syz by simultaneously applying two different actuator-driving control voltages Vx and Vy to the ion conductive polymer streak 220. In this embodiment, furthermore, the antenna conductor 21 is a linear member covered with a cover 23 together with the actuator member 22, so that the antenna conductor 21 can be displaced (deformed) integrally with the actuator member 22.

Therefore, the displacement of the antenna device 2 of the present embodiment, which occupies a certain position in the space, can be controlled in response to the direct currents Vx and Vy supplied to the paired electrodes 25*x* and 26*x* and the paired electrodes 25*y* and 26*y* formed on the ion conductive polymer streak 220.

Therefore, by regulating the actuator driving control voltages Vx and Vy to be applied to the antenna device 2 of the present embodiment, a specific position of the antenna device 2 with respect to the housing 1 can be brought into a desired state.

The cellular phone terminal 10, which serves as a communication apparatus of the present embodiment, the antenna device 2 is subjected to displacement control so that it is allowed to obtain an appropriate reception condition while changing its position to satisfy the criterion of the electromagnetic waves acceptable to the human body. Hereinafter, the substantial configuration of the cellular phone terminal 10 in this example will be described in detail.

<Exemplary Hardware Configuration of Internal Circuit of Cellular Phone Terminal 10>

Figure 6:
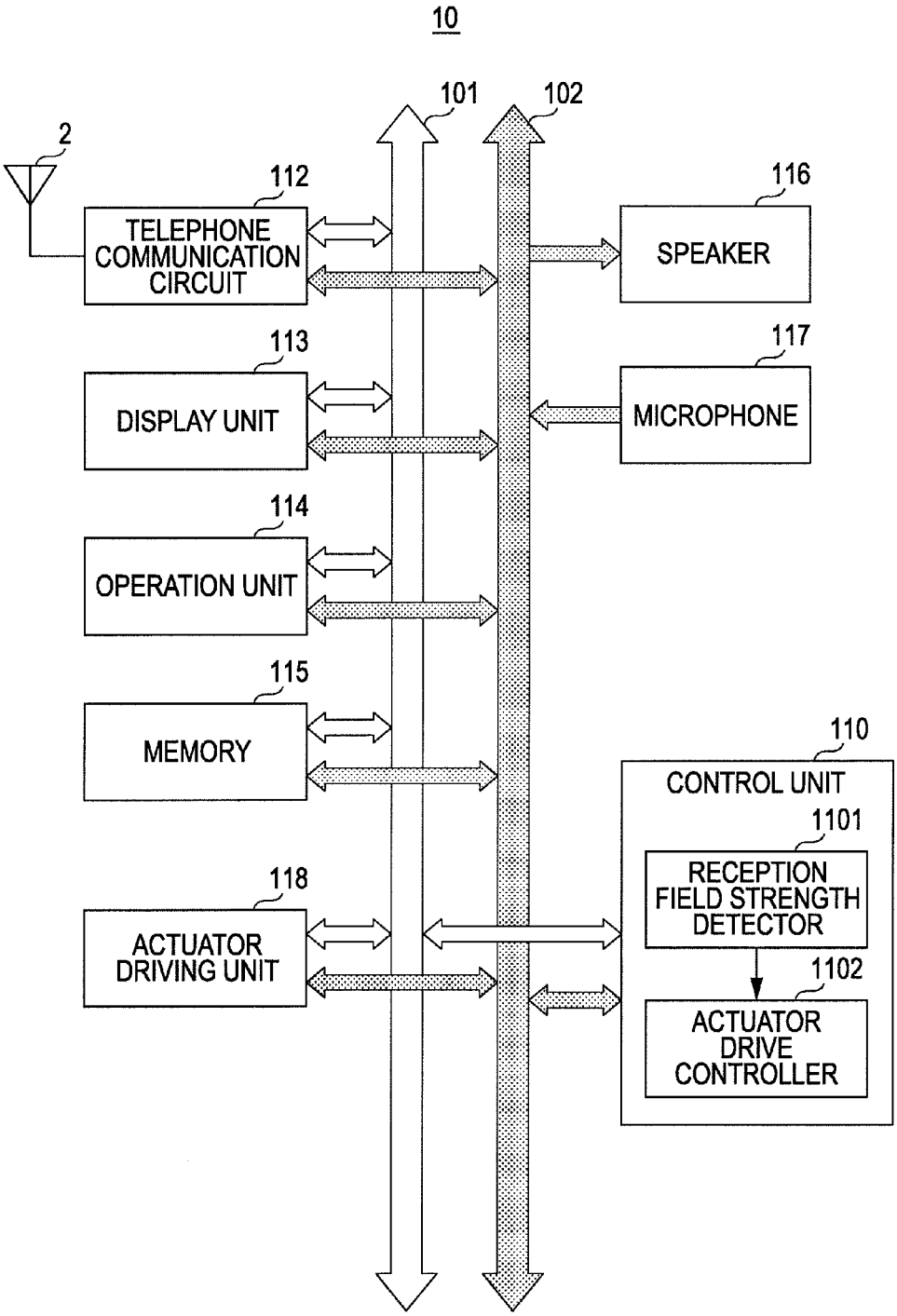
FIG. 6 is a diagram illustrating an exemplary hardware configuration of an inner circuit of the cellular phone terminal according to the embodiment of the present invention.

FIG. 6 is a block diagram illustrating the exemplary hardware configuration of the inner circuit of the cellular phone terminal 10. In the cellular phone terminal 10 of the present embodiment, a system bus including a control bus 101 and a data bus 102 is connected to a control unit 110 including a microcomputer. In addition, the system bus is connected to a telephone communication circuit 112, a display unit 113, an operation unit 114, a memory 115, a speaker 116, a microphone 117, and an actuator-driving unit 118 (the actuator driving circuit 12 is built in).

The microcomputer in the control unit 110 stores software programs for controlling various kinds of processing of the cellular phone terminal 10 of the present embodiment. The control unit 110 performs various kinds of control processing according to the software programs.

The software programs include a sequence control program for sending a message (calling) or receiving an incoming message and a displacement control program of the antenna device 2. Such a displacement control program is responsible for attaining an optimal receiving state while satisfying the criterion of the electromagnetic waves acceptable to the human body.

The telephone communication circuit 112 is a wireless communication unit for cellular phone communication to carry out telephone communication through a base station and a cellular phone network and other kinds of information communication (including the communication through the Internet). The telephone communication circuit 112 can send and receive communication data through the antenna device 2. The telephone communication circuit 112 includes the aforementioned antenna circuit 11.

The display unit 113 includes a display device such as a liquid crystal display and has functions of representing various kinds of display screens and performing monitor display of shot video images, while the display element receives the control of the control unit 110.

The operation unit 114 includes a ten key, a cross key for menu selection, and other keys. The control unit 110 detects whether any key is operated through the operation unit 114 and then executes a control processing operation corresponding to the operated key.

In this embodiment, the memory 115 stores various kinds of data including a telephone book data, mail addresses, and partner's URL (Uniform Resource Locator) through the Internet. Furthermore, the memory 115 also stores accumulated data (such as an amplification program) in the cellular phone terminal.

In the embodiment, furthermore, the memory 115 stores allowable range information about the actuator driving control voltages Vx and Vy that allow the antenna device 2 to satisfy the aforementioned local SAR.

In this example, the allowable range information about the actuator-driving control voltages Vx and Vy includes voltage levels Vxmax and Vymax when the antenna conductor 21 is located most far from the human body and voltage levels Vxmin and Vymin when the antenna device 21 is located nearest from the human body while satisfying the local SAR.

The speaker 116 carries out a function of reproducing a received voice in telephone communication and also a function of audio reproduction of voice data reproduced from the received delivered information. The microphone 117 is provided for collecting transmitted voices in telephone communication.

In this embodiment, furthermore, the control unit 110 is specifically designed to additionally execute control processing as operation parts shown in the figure using stored programs.

In other words, in this embodiment, the control unit 110 includes the reception field strength detector 1101 as an operation part and an actuator drive controller 1102 as another operation part.

The reception field strength detector 1101 performs processing of determining a reception field strength based on a received signal from the antenna circuit 11 of the telephone communication circuit 112. Then, the reception field strength detector 1101 notifies the information about the determined reception field intensity to the actuator drive controller 1102.

The actuator drive controller 1102 generates actuator-driving control voltages Vx and Vy that displace (deform) the actuator member 22 of the antenna device 2. When generating the actuator-driving control voltages Vx and Vy, the actuator drive controller 1102 gives consideration to the reception field intensity determined by the reception field intensity detector 1101 and the allowable range information about the actuator-driving control voltages that satisfy the criterion of the local SAR stored in the memory 115.

The reception field strength detected by the reception field strength detector 1101 depends on the strength of the electromagnetic waves (the amount of energy) at the position of the antenna device 2. Therefore, the actuator drive controller 1102 controls actuator-driving control voltages Vx and Vy being generated while monitoring the reception field strength determined by the reception field strength detector 1101 to carry out adjustment of an appropriate antenna position.

Furthermore, the actuator drive controller 1102 controls the actuator-driving control voltages Vx and Vy being generated within available range information stored in the memory 115, thereby typically satisfying the local SAR conditions.

The actuator driving unit 118 generates actual DC currents Vx and Vy supplied to the actuator member 22 in response to the information about the actuator drive controller 1102 of the control unit 110, followed by supplying the actual DC currents Vx and Vy to the actuator member 22.

Figure 7:
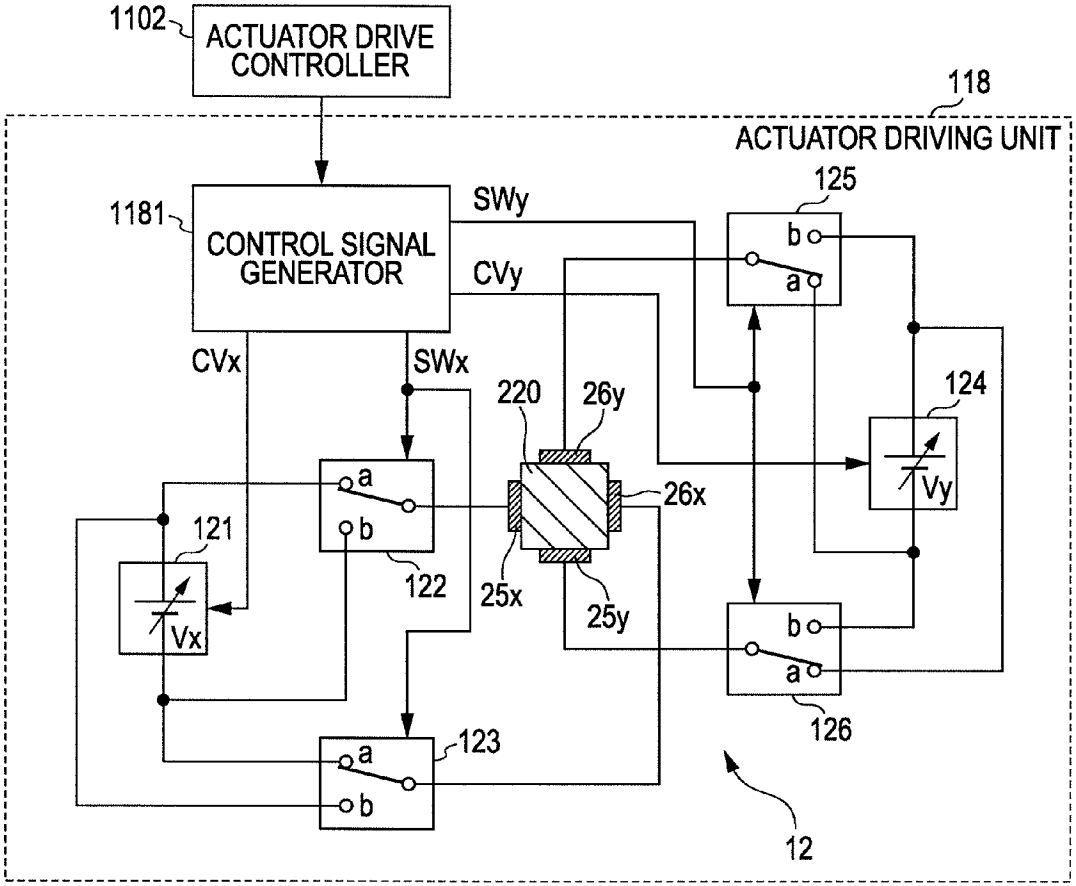
FIG. 7 is a diagram illustrating an exemplary configuration of an actuator drive circuit in the antenna device according to the embodiment of the present invention.

FIG. 7 is a diagram illustrating an exemplary configuration of the actuator driving unit 118 of the present embodiment.

As shown in FIG. 7, the actuator driving unit 118 of the present embodiment includes an actuator driving circuit 12 and a control signal generator 1181.

The control signal generator 1181 receives the information about the actuator driving control voltages Vx and Vy from the actuator drive controller 1102 and then generates various control signals SWx, SWy, CVx, and CYy to be supplied to the actuator driving circuit 12.

The actuator driving circuit 12 includes a variable DC power supply 121 that generates an actuator-driving control voltage Vx and a variable DC power supply 124 that generates an actuator-driving control voltage Vy.

The control signal generator 1181 references the information about the level of an actuator-driving control voltage Vx from the actuator drive controller 1102 and then generates a control signal CVx for outputting such a level of the DC current Vx from the variable DC power supply 121, followed by supplying the generated control signal CVx to the variable DC power supply 121.

In addition, the control signal generator 1181 references the information about the level of an actuator-driving control voltage Vy from the actuator drive controller 1102 and then generates a control signal CVy for outputting such a level of the DC current Vy from the variable DC power supply 124, followed by supplying the generated control signal CVy to the variable DC power supply 124.

The anode end and the cathode end of the variable DC power supply 121 are connected to the paired electrodes 25*x* and 26*x* of the actuator member 22 through voltage-polarity switching circuits 122 and 123, respectively.

The control signal generator 1181 references the information about the polarity of an actuator-driving control voltage Vx from the actuator drive controller 1102 and then generates a control signal SWx for simultaneously switching the switching circuits 122 and 123, followed by supplying the generated control signal SWx to the switching circuits 122 and 123.

In the example shown in FIG. 7, if each of the switching circuits 122 and 123 is switched from the terminal "b" to the terminal "a" in response to the control signal SWx, the actuator-driving control voltage Vx is applied so that the electrode 25*x* serves as an anode and the electrode 26*x* serves as a cathode. In addition, if each of the switching circuits 122 and 123 is switched from the terminal "a" to the terminal "b", then the actuator-driving control voltage Vx is applied so that the electrode 25*x* serves as a cathode and the electrode 26*x* serves as an anode.

Similarly, the anode end and the cathode end of the variable DC power supply 124 are connected to the paired electrodes 25*y* and 26*y* of the actuator member 22 through voltage-polarity switching circuits 125 and 126, respectively.

The control signal generator 1181 references the information about the polarity of an actuator-driving control voltage Vy from the actuator drive controller 1102 and then generates a control signal SWx for simultaneously switching the switching circuits 125 and 126, followed by supplying the generated control signal SWy to the switching circuits 125 and 126.

In the example shown in FIG. 7, if each of the switching circuits 125 and 126 is switched from the terminal "b" to the terminal "a" in response to the control signal SWy, the actuator-driving control voltage Vy is applied so that the electrode 25*y* serves as an anode and the electrode 26*y* serves as a cathode. In addition, if each of the switching circuits 125 and 126 is switched from the terminal "a" to the terminal "b", then the actuator-driving control voltage Vy is applied so that the electrode 25*y* serves as a cathode and the electrode 26*y* serves as an anode.

<Exemplary Operation of Displacement Control Processing of Antenna Device 2>

FIRST EXAMPLE

A first exemplary operation of displacement control processing of the antenna device 2 in the cell phone terminal 10 will be described with reference to FIG. 10 to FIG. 14 in addition to the flowchart shown in FIG. 8 and FIG. 9.

In the cellular phone terminal 10 of the present invention, when receiving an incoming message or sending a message (calling), the antenna conductor 21 of the antenna device 2 is subjected to displacement control to satisfy the conditions of local SAR and to attain an appropriate reception state to perform subsequent communication (call).

Figure 8:
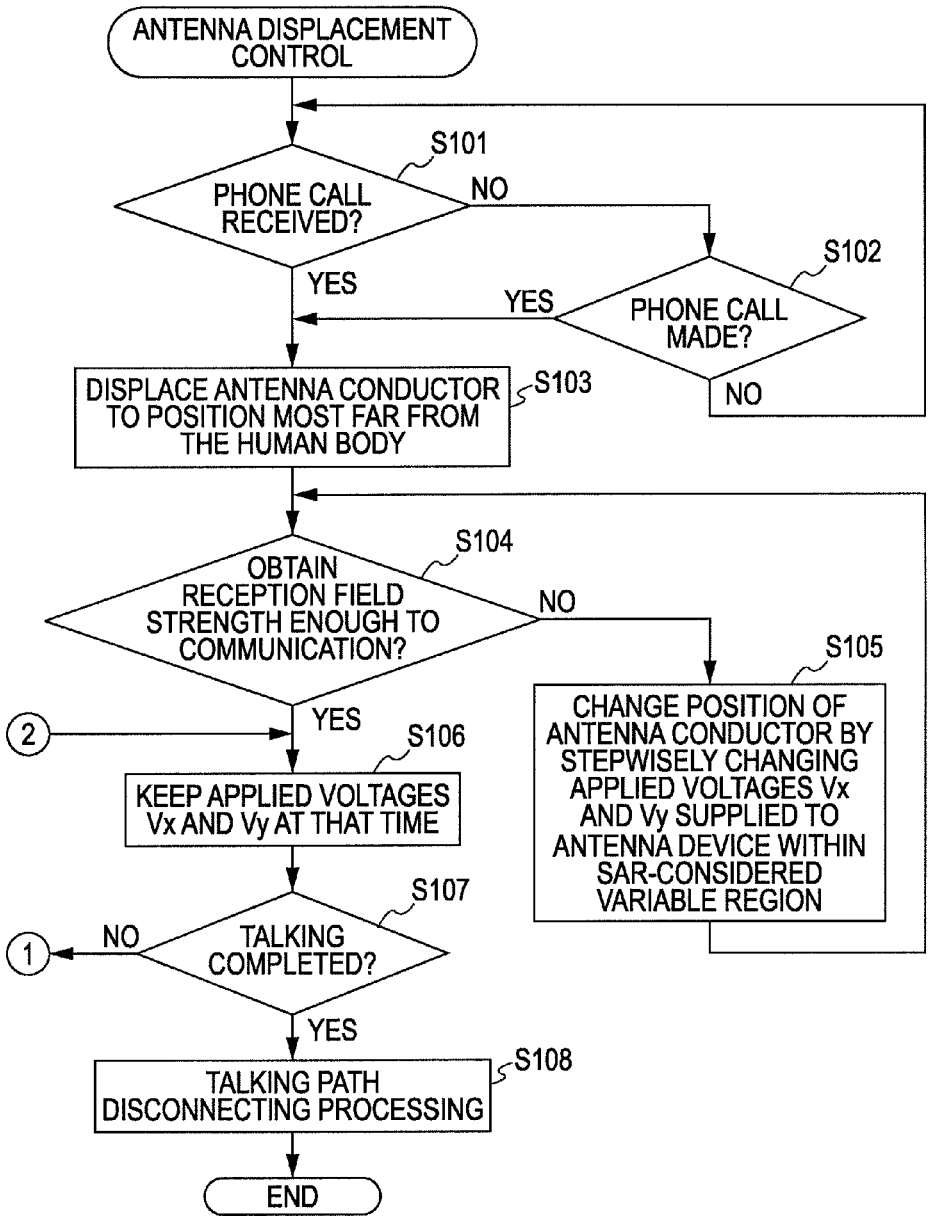
FIG. 8 is a diagram illustrating part of a flowchart that describes an exemplary processing of displacement control on the antenna conductor in the antenna device according to the embodiment of the present invention.
Figure 9:
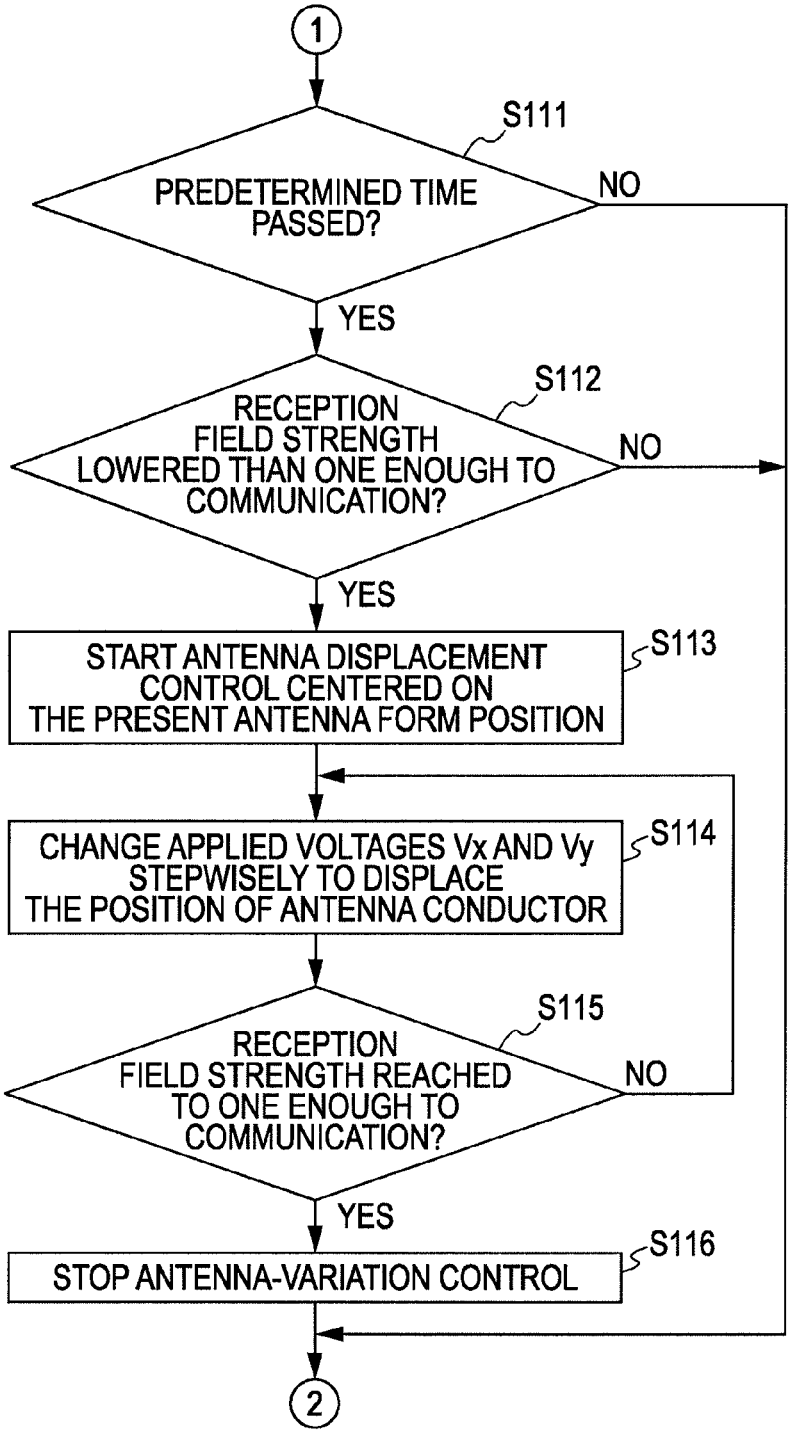
FIG. 9 is a diagram illustrating part of a flowchart that describes an exemplary processing of displacement control on the antenna conductor in the antenna device according to the embodiment of the present invention.

FIG. 8 and FIG. 9 illustrate a flowchart illustrating an example of processing for antenna displacement control carried out by the control unit.

First, the control unit 110 determines whether a phone call is received (Step S101). If there is no incoming call detected, then it is determined whether a phone call (call request) is made (Step S102). If there is no phone call (call request) detected in the step S102, then the process returns to the step S101.

Then, an incoming call is detected in the step S101 or a phone call (call request) is detected in the step S102, then the control unit 110 activates the actuator drive controller 1102 and controls the displacement of the antenna conductor 21 of the antenna device 2 to an initial position (most far from the human body (the head)) (hereinafter, also referred to as a most far position). In other words, in this example, the control unit 1101 supplies an actuator-driving control voltage Vx to between the electrodes 25*x* and 26*x* and an actuator-driving control voltage Vy to between the electrode 25*y* and 26*y* of the actuator member 22 of the antenna device 2, where the voltages Vx and Vy allow the antenna conductor 21 to be displaced to the most far position (Step S103). Therefore, the conditions of local SAR can be unexceptionally satisfied n the initial stages.

Figure 10A:
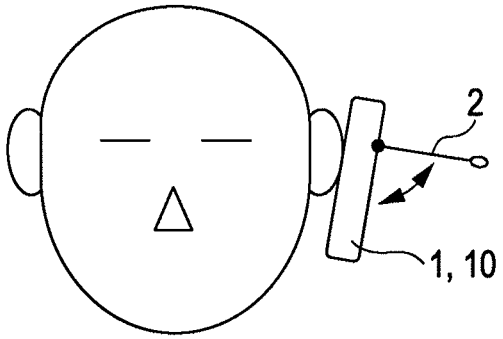
FIG. 10 is a diagram illustrating an exemplary processing of displacement control on the antenna conductor in the antenna device according to the embodiment of the present invention.
Figure 10B:
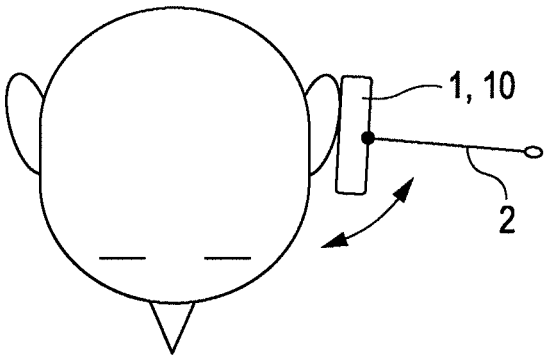

In this example, when the antenna conductor 21 is displaced to the most far position, the state of the actuator member 22 is in a state that the longitudinal direction of the actuator member 22 is almost perpendicular to the surface 1*b* of the housing 1 as represented in FIG. 10A and FIG. 10B. At this time, in this example, the levels of the actuator-driving control voltages Vx and Vy are Vx=Vy=zero (0) volt.

Here, the state of the actuator member 22 at the most far position may be not in a state that the longitudinal direction of the actuator member 22 is almost perpendicular to the surface 1*b* of the housing 1 as in the case of this example. Alternatively, it may be in a state of being displaced as shown in FIG. 4A or FIG. 4C.

In this case, Vx=Vy=Vo volt (Vo is any value but not zero (0)). In this example, each of the actuator-driving control voltages Vx and Vy is set to zero (0) volt which allows the actuator member 22 to be almost perpendicular to the surface 1*b* of the housing 1. If a predetermined voltage is applied, the actuator member 22 may be almost perpendicular to the surface 1*b* of the housing 1.

Next, the control unit 110 allows the reception field strength detector 1101 to determine a reception field strength at the most far position and determines whether a reception field strength enough to communication can be obtained (step S104).

If the step S104 determines that the reception field strength enough to communication is not obtained, then the control unit 110 changes the levels of the actuator-driving control voltages Vx and Vy stepwisely within the range that satisfies the local SAR, the criterion of the electromagnetic waves acceptable to the human body. The actuator member 22 is deformed (displaced) to displace the antenna conductor 2 (Step S105).

After the step S105, the process returns to the step S104. Then, the control unit 110 determines whether a reception field strength enough to communication is obtained at the position of the antenna conductor 21 being displaced. The control unit 110 repeats the processing in the step S104 and the processing in the step S105 until the step S104 determines that a sufficient reception field strength enough to communication is obtained.

Figures 11, 12:
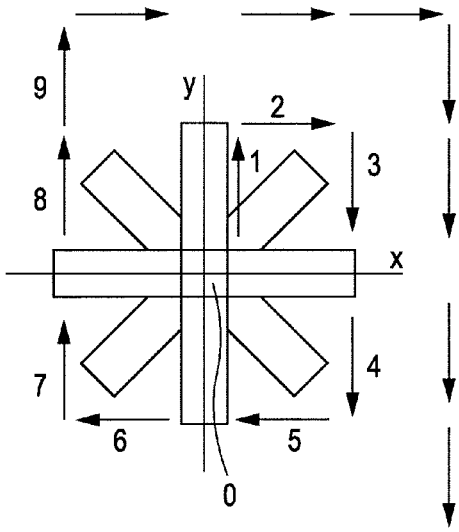
FIG. 11 is a diagram illustrating an exemplary processing of displacement control on the antenna conductor in the antenna device according to the embodiment of the present invention.
FIG. 12 is a diagram illustrating an exemplary processing of displacement control on the antenna conductor in the antenna device according to the embodiment of the present invention.

FIG. 11 is a diagram illustrating an example of the movement of the actuator member 22 when the step S104 and the step S105 are repeated. Furthermore, to cause the movement of the actuator member 22 as exemplified in FIG. 11, the actuator-driving control voltages Vx and Vy to be stepwisely changed to displace the actuator member 22 are exemplified in FIG. 12.

FIG. 11 is a schematic diagram illustrating that the movement of the ion conductive polymer streak 220 of the actuator member 22 when the antenna device 2 is controllably displaced, showing from the above of the free end opposite to the end fixed on the attaching portion 1*c* in the longitudinal direction of the streak 220. In FIG. 11, arrows and numerals denote displacement directions and displaced position numbers (the sequence of stepwise displacement) of the actuator member 22 in the respective steps when the actuator-driving control voltages Vx and Vy are stepwisely changed.

As shown in FIG. 10, for example, the initial control position of the actuator member 22, the most far position thereof as described above, is Vx=Vy=0 (zero) (therefore, the actuator member 22 is in a straightened state). In FIG. 11, this position is assigned position number 0.

A stepwise change in control voltage is repeated in the step S105 until a reception field strength enough to communication is obtained. Then, the ion conductive polymer streak 220 is deformed and the edge of the free end of the actuator member 22 is controllably displaced so as to be located as represented by the sequence of position numbers shown in FIG. 11. In this example, in other word, the edge of the free end opposite to the fixed end in the longitudinal direction of the ion conductive polymer streak 220 of the actuator member 22 is controllably displaced in sequence as represented by position numbers in FIG. 11.

As is evident from a change in position number shown FIG. 11, in this embodiment, the free end of the ion conductive polymer streak 220 of the actuator member 22 is stepwisely displaced in sequence around the position number 0 to draw a spiral so that the radius of the spiral pattern is increased gradually.

As shown in FIG. 12 in this example, the step S105 defines increased and decreased step voltages to stepwisely change one of the voltages Vx and Vy with respect to a change in position number in FIG. 11.

In the example shown in FIG. 12, the step voltage that displaces the ion conductive polymer streak 220 to a predetermined distance in the direction included in the plane Sxz is defined as ΔVx and the polarity thereof depends on the direction along which the user intends to displace. Likewise, the step voltage that displaces the ion conductive polymer streak 220 to a predetermined distance in the direction included in the plane Syz is defined as ΔVy and the polarity thereof depends on the direction along which the user intends to displace.

In FIG. 12, increased and decreased voltages are defined one by one in order of position numbers until a reception field strength enough to communication is obtained. When the ion conductive polymer streak 220 is displaced from one position number to another, the increased or decreased step voltage defined therefor is increased or decreased with respect to the last actuator-driving control voltages Vx and Vy to set new actuator-driving control voltages Vx and Vy as shown in the table of FIG. 12.

The actuator-driving control voltages Vx and Vy listed in the table shown in FIG. 12 are applied to between the electrodes 25*x* and 26*x* and between the electrodes 25*y* and 26*y* of the actuator member 22, respectively.

In this case, depending on the polarities of the actuator-driving control voltages Vx and Vy, the switching circuits 122 and 123 and the switching circuits 125 and 126 of the actuator driving circuit 12 of FIG. 7 are switched, respectively. In the actuator driving circuit 12 of FIG. 7, furthermore, the variable DC power supplies 121 and 124 are controlled so that the levels of the actuator-driving control voltages Vx and Vy from the variable DC power supplies 121 and 124 reach to values (absolute values) at their respective position numbers in FIG. 12, respectively.

As described above, if the procedures in the steps S104 and S105 are performed and the step S104 concludes that the reception field strength enough to communication is obtained, then the control unit 110 suspends the displacement of the actuator member 22 under control and continues the application of voltages Vx and Vy at that position (Step S106).

Next, if the control unit 110 determines whether a phone call (communication) was terminated (step S107) and finds that the phone call (communication) was not completed, then it is determined whether a predetermined time is passed from the time at which the control of the actuator displacement under control was stopped (step S111 in FIG. 9). In the step S111, if it is found that the predetermined time has not been passed, then the control unit 110 returns the process to the step S106 to keep the states of applied voltages Vx and Vy as they are.

In the step S111, if it is found that the predetermined time has been passed, then the control unit 110 references the result of the determination in the reception field strength detector 1101 at this time and determines whether the reception field strength is lower than one enough to communication (Step S112).

In this step S112, if it is found that the reception field strength is not lower than one enough to communication, then the control unit 110 returns the process to the step S106 and keeps the states of applied voltages Vx and Vy as they are.

In the step S112, if it is found that the reception field strength is lower than one enough to communication, then the control unit 110 starts to control stepwise displacement of the antenna centering the antenna position at the present moment (Step S113). Then, the control unit 110 changes the levels of applied voltages Vx and Vy stepwisely in a manner similar to the step S105. Then the actuator member 22 is deformed (displaced) to displace the antenna conductor 2 (Step S114).

Subsequently, the control unit 115 determines whether a reception field strength enough to communication is obtained at the position of the antenna conductor 21 being displaced (Step S115). If the step S115 determines that the reception field strength enough to communication is not obtained, then the control unit 110 returns the process to the step S114. The control unit 110 repeats the processing in the step S114 and the processing in the step S115 until the step S115 determines that a sufficient reception field strength enough to communication is obtained.

Figures 13, 14:
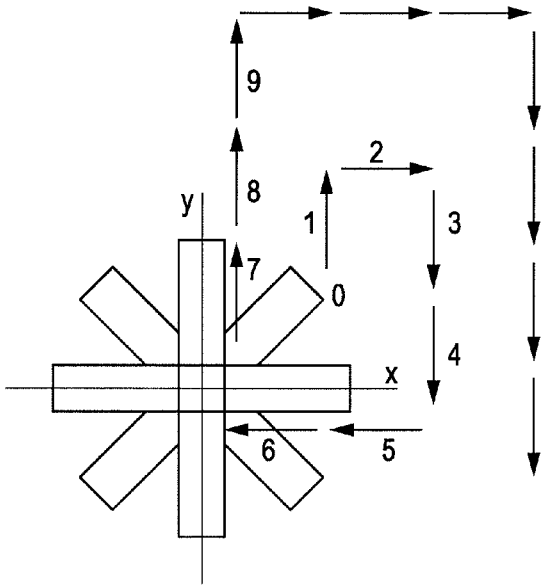
FIG. 13 is a diagram illustrating an exemplary processing of displacement control on the antenna conductor in the antenna device according to the embodiment of the present invention.
FIG. 14 is a diagram illustrating an exemplary processing of displacement control on the antenna conductor in the antenna device according to the embodiment of the present invention.

FIG. 13 is a diagram illustrating an example of the movement of the actuator member 22 when the step S114 and the step S115 are repeated. Furthermore, to cause the movement of the actuator member 22 as exemplified in FIG. 13, the actuator-driving control voltages Vx and Vy to be stepwisely changed to displace the actuator member 22 are exemplified in FIG. 14.

Like the case in FIG. 11 as described above, FIG. 13 is a schematic diagram illustrating that the movement of the ion conductive polymer streak 220 of the actuator member 22 when the antenna device 2 is controllably displaced, showing from the above of the free end opposite to the end fixed on the attaching portion 1*c* in the longitudinal direction of the streak 220. In FIG. 13, arrows and numerals denote displacement directions and displaced position numbers (the sequence of stepwise displacement) of the actuator member 22 in the respective steps when the actuator-driving control voltages Vx and Vy are stepwisely changed.

As shown in FIG. 13, in the processing carried out in each of the step S114 and the step S115, the antenna position at which the actuator displacement control is initiated in the step S113 is defined as "position number 0 (zero)".

Then, as shown in FIG. 13, the processing in each of the step S114 and the step S115, the free end of the ion conductive polymer streak 220 of the actuator member 22 is stepwisely displaced in sequence around the displacement position of position number 0 to draw a spiral so that the radius of the spiral pattern is increased gradually.

As shown in FIG. 14, the step S115 defines increased and decreased step voltages to stepwisely change one of the voltages Vx and Vy with respect to a change in position number in FIG. 13. In the example shown in FIG. 14, the step voltage that displaces the ion conductive polymer streak 220 to a predetermined distance in the direction included in the plane Sxz is defined as ΔVx and the polarity thereof depends on the direction along which the user intends to displace. Likewise, the step voltage that displaces the ion conductive polymer streak 220 to a predetermined distance in the direction included in the plane Syz is defined as ΔVy and the polarity thereof depends on the direction along which the user intends to displace.

In FIG. 14, increased and decreased voltages are defined one by one in order of position numbers until a reception field strength enough to communication is obtained. When the ion conductive polymer streak 220 is displaced from one position number to another, the increased or decreased step voltage defined therefore is increased or decreased with respect to the last actuator-driving control voltages Vx and Vy to set new actuator-driving control voltages Vx and Vy as shown in the table of FIG. 14.

The actuator-driving control voltages Vx and Vy listed in the table shown in FIG. 14 are controlled in a manner similar to one in the aforementioned step S105. Then the actuator-driving control voltages Vx and Vy can be controlled so that they can be obtained from the variable DC power supplies 121 and 124 of the actuator driving circuit 12 shown in FIG. 7. In addition, the switching circuits 122 and 123 and the switching circuits 125 and 126 are switched depending on the polarities of the actuator-driving control voltages Vx and Vy listed in the table shown in FIG. 14, respectively.

If the procedures in the steps S114 and S115 are performed and the step S115 concludes that the reception field strength enough to communication is obtained, then the control unit 110 suspends the displacement of the actuator member 22 (Step S116). The process proceeds to the step S106 under control and continues the application of voltages Vx and Vy at that position (Step S106).

If the step S107 determines that the user has finished talking (communication), then the control unit 110 disconnects the talking path (step S108) and then terminates this processing routine.

As described above, in the cellular phone terminal 10, if an incoming phone call or an outgoing phone call is detected, then the antenna conductor 21 of the antenna device 2 satisfies local SAR, the criterion of the electromagnetic waves acceptable to the human body and is automatically displaced to a suitable state for receiving sensitivity.

SECOND EXAMPLE

In the first example, the actuator member 22 of the antenna device 2 is stepwisely displaced (deformed) under control. Therefore, the position of the antenna device 2 can be finely adjusted for more appropriate reception by reducing the width of the step voltage.

Alternatively, for sake of simplicity, several pieces of information about actuator-driving control voltage, which are those about several candidate positions as appropriate antenna positions, are stored as different pieces of table information in advance. Then, an appropriate piece of the information is selected among these plural pieces of table information. Therefore, the antenna device 2 can be comparatively easily and quickly displaced to an appropriate one under control. An example of such a case will be described as a second example. FIG. 15 and FIG. 16 are diagrams illustrating exemplary table information for actuator-driving control voltages which are prepared in advance. For sake of simplicity, FIG. 15 represents only information about four tables A, B, C, and D. Alternatively, however, more tables may be prepared.

In this example, these pieces of the table information are previously stored in the memory 115. Alternatively, these pieces of the table information may be stored in a built-in memory part (not shown) of the control unit 110.

As shown in FIG. 16, the table information of this second example includes the information about each pair of actuator-driving control voltages Vx and Vy. The voltage levels of the actuator-driving control voltages Vx and Vy as the table information are responsible for placing the antenna device 2 at a predictive position where the local SAR can be satisfied with respect to the electromagnetic waves acceptable to the human body and a reception field strength enough to communication can be obtained.

Figure 15A:
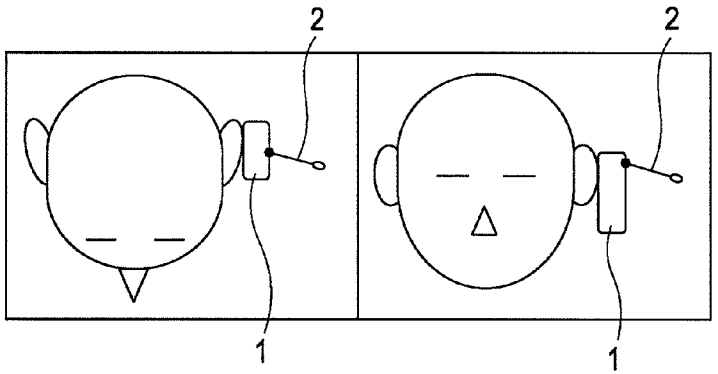
FIG. 15 is a diagram illustrating another exemplary processing of displacement control on the antenna conductor in the antenna device according to the embodiment of the present invention.

For example, the table A includes a pair of pieces of information about actuator-driving control voltage Vx=VxA and actuator-driving control voltage Vy=VyA, which lead to the state of the antenna device 2 shown in FIG. 15A with respect to the housing 1 when the user holds the cellular phone terminal 10 near the ear. Here, the voltage VxA and the voltage VyA also include their respective polarities. Hereinafter, the same will apply.

Figure 15B:
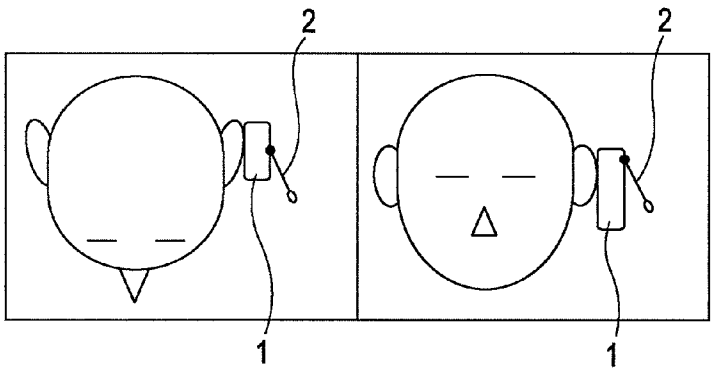

Likewise, the table B includes a pair of pieces of information about actuator-driving control voltage Vx=VxB and actuator-driving control voltage Cy=VyB, which lead to the state of the antenna device 2 shown in FIG. 15B with respect to the housing 1.

Figure 15C:
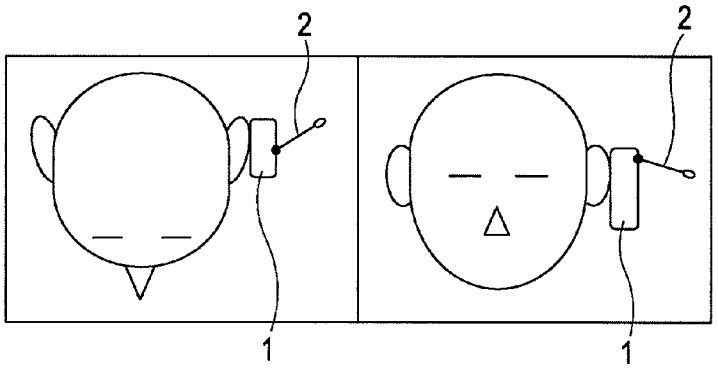
Figure 15D:
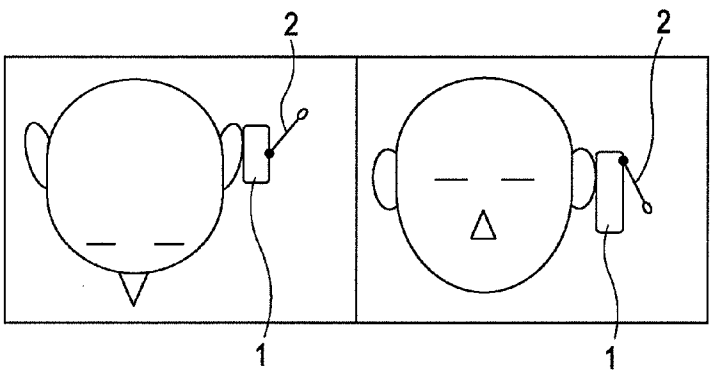

Similarly, the tables C and D includes a pair of pieces of information about actuator-driving control voltages VxC and VyC and a pair of pieces of information about actuator-driving control voltages VxD and VyD, which lead to the states of the antenna device 2 shown in FIGS. 15C and 15D with respect to the housing 1, respectively.

The sequence of reading out these pieces of the table information is previously determined. Thus, the control unit 110 reads out the table information according to the predetermined reading-out sequence and searches a suitable antenna position with reference to the reception field strength at the antenna position from the table information.

Figure 17:
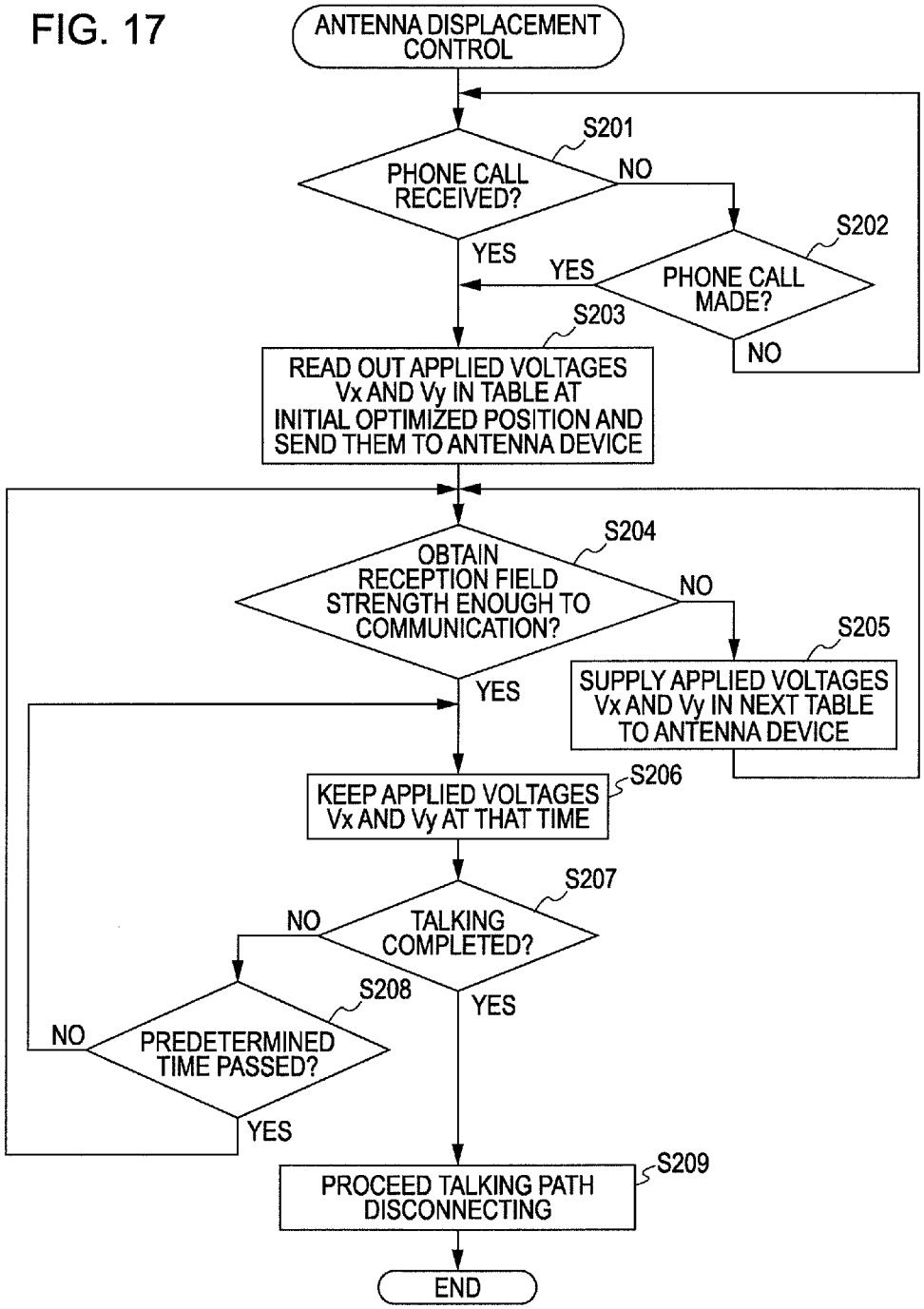
FIG. 17 is a diagram illustrating a flowchart that describes another exemplary processing of displacement control on the antenna conductor in the antenna device according to the embodiment of the present invention.

A second exemplary operation of displacement control processing of the antenna device 2 using these pieces of the table information will be described with reference to the flowchart shown in FIG. 17. The procedure in each of the steps shown in FIG. 17 is executed by the control unit 110 as in the case with the example shown in FIG. 8 and FIG. 9.

First, the control unit 110 determines whether an incoming phone call is detected (Step S201). If the incoming phone call is not detected, then the control unit 110 determines whether an outgoing phone call (call request) is made (Step S202). If there is no outgoing phone call (call request) detected, then the process returns to the step S201.

Then, if an incoming phone call is detected in the step S201 or an outgoing phone call (call request) is detected in the step S202, then the control unit 110 activates the actuator drive controller 1102. In this second example, the actuator drive controller 1102 reads out the table information which has been determined as one to be read out first (table information about an initial optimal position) and then supplies the read-out applied voltages Vxi and Vyi (i=A, B, C, . . . ) to the antenna device 2 through the actuator driving unit 118 (Step S203).

Next, the control unit 110 allows the reception field strength detector 1101 to determine a reception field strength at the position of the antenna device 2 displaced by the information under control and then determines whether a reception field strength enough to communication is obtained (Step S204).

In the step S204, if it is found that a sufficient reception field strength enough to communication is not obtained, then the control unit 110 reads out the next table information and the actuator member 22 of the antenna device 2 is then displaced by the actuator driving unit 118 under control (Step S205).

Subsequent to the step s205, the process returns to the step S204 and the control unit 110 determines whether a reception field strength sufficient to communication is obtained at the position of the antenna conductor 21 being displaced. Subsequently, the control unit 110 repeats the processing in the step S204 and the processing in the step S205 until the step S204 determines that a sufficient reception field strength enough to communication is obtained.

As described above, if the procedures in the steps S204 and S205 are performed and the step S204 concludes that the reception field strength enough to communication is obtained, then the control unit 110 suspends the displacement of the actuator member 22 under control and continues the application of voltages Vx and Vy at that position (Step S206).

Next, if the control unit 110 determines whether a phone call (communication) was terminated (step S207) and finds that the phone call (communication) was not completed, then it is determined whether a predetermined time is passed from the time at which the control of the actuator displacement under control was stopped (step S208). In the step S208, if it is found that the predetermined time has not been passed, then the control unit 110 returns the process to the step S206 to keep the states of applied voltages Vx and Vy as they are.

In the step S208, if it is found that the predetermined time has been passed, then the control unit 110 returns the process to the step S204, references the result of the determination in the reception field strength detector 1101 at this time, and determines whether the reception field strength is lower than one enough to communication.

In this step S204, if it is found that the reception field strength enough to communication is obtained, then the control unit 110 returns the process to the step S206 and keeps the states of applied voltages Vx and Vy as they are.

In the step S204, if it is found that the reception field strength sufficient to communication is no longer obtained, then the control unit 110 advances the process to the step S205 to read out the next table information, which is one subsequent to the present table information, followed by executing antenna-displacement control. The control unit 110 repeats the step S204 and the step S205 until the step S205 determines that a sufficient reception field strength enough to communication is obtained.

If the step S207 determines that the user has finished talking (communication), then the control unit 110 disconnects the talking path (step S209) and then terminates this processing routine.

As described above, in the cellular phone terminal 10, if an incoming phone call or an outgoing phone call is detected, then the antenna conductor 21 of the antenna device 2 satisfies local SAR, the criterion of the electromagnetic waves acceptable to the human body and is automatically displaced to a suitable state for receiving sensitivity.

[Another Embodiment or Modified Example]

<First Modified Example of Antenna Device 2>

Figure 18A:
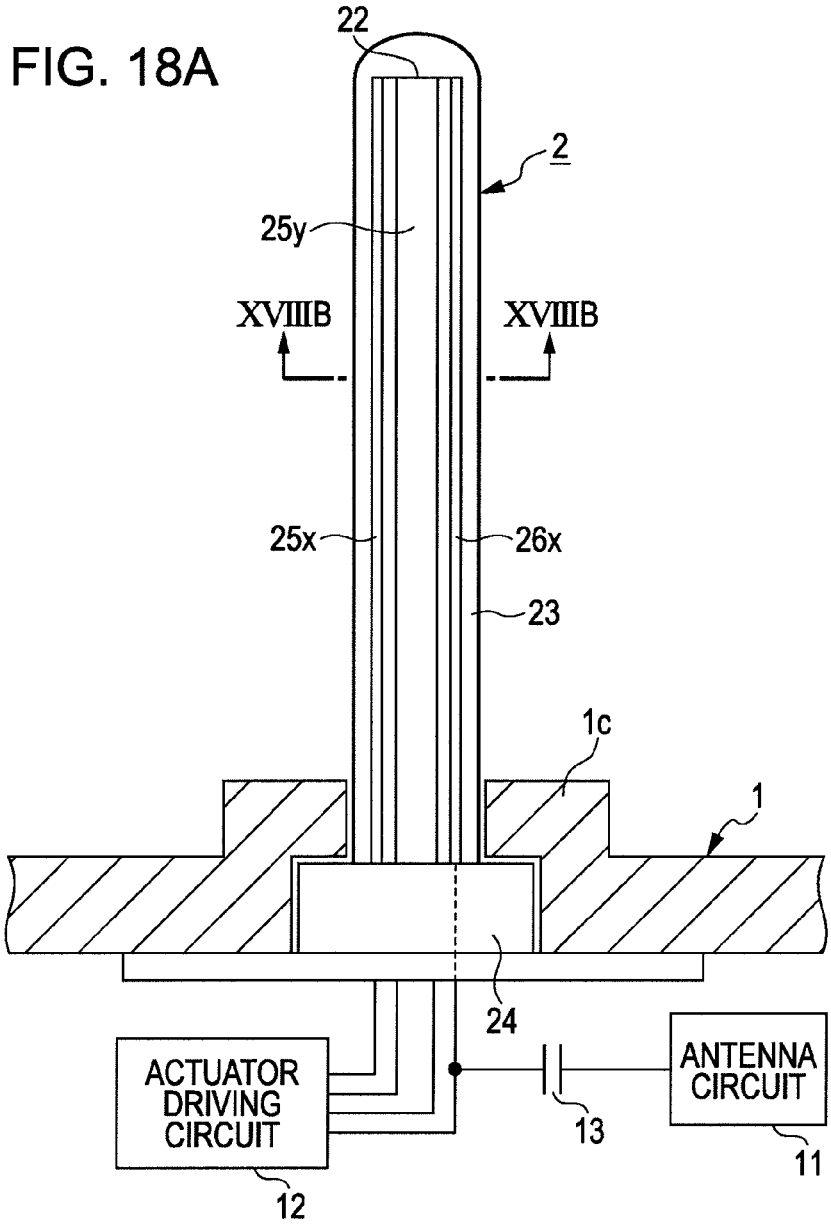
FIG. 18 is a diagram illustrating an antenna device according to another embodiment of the present invention.
Figure 18B:
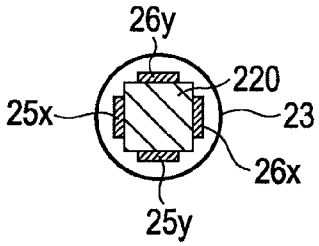

In the antenna device 2 of the aforementioned example, the antenna conductor 21 is formed independently from the electrodes 25*x*, 25*y*, 26*x*, and 26*y* of the actuator member 22. Alternatively, the antenna conductor 21 may be also used as an electrode of the actuator member 22. According to such an example, FIG. 18A and FIG. 18B are diagrams illustrating an exemplary configuration of the antenna device 2 and the related circuits in the insides of both the antenna device 2 and the cellular phone terminal 10.

In the example shown in FIG. 18, the electrode 26*x* also serves as an antenna conductor. In this example, an actuator-driving control voltage Vx is supplied from the actuator drive circuit 12 to between the electrode 25*x* and the electrode 26*x* and the electrode 26*x* is connected to the antenna circuit 11 through a DC-blocking capacitor 13.

Therefore, it is not necessary to independently form an antenna conductor 21 and the configuration of the antenna device 2 can be simplified. In the antenna device 2 of the present example, the antenna conductor of the actuator member 22 serves as an electrode. Thus, the antenna conductor is directly supported by the actuator member 22.

In the aforementioned embodiment, the cover 23 of the antenna device 2 serves as an auxiliary member employed at the time of displacing the antenna conductor 21 by the actuator member 22 under control. Thus, the cover 23 should be made of a material that integrally displaces the antenna conductor 21 and the actuator member 22. In this example, in contrast, the antenna conductor is directly supported by the actuator member 22. Thus, the cover 23 of the antenna device 2 may be any of materials that can cover the actuator member 22.

Furthermore, in the case of also using the electrode of the actuator member 22 as an antenna conductor, the electrode that also serves as the antenna conductor may be two or more instead of one. In this case, the electrode that also serves as the antenna device is connected to the antenna circuit 11 through the DC-blocking capacitor.

Figure 19:
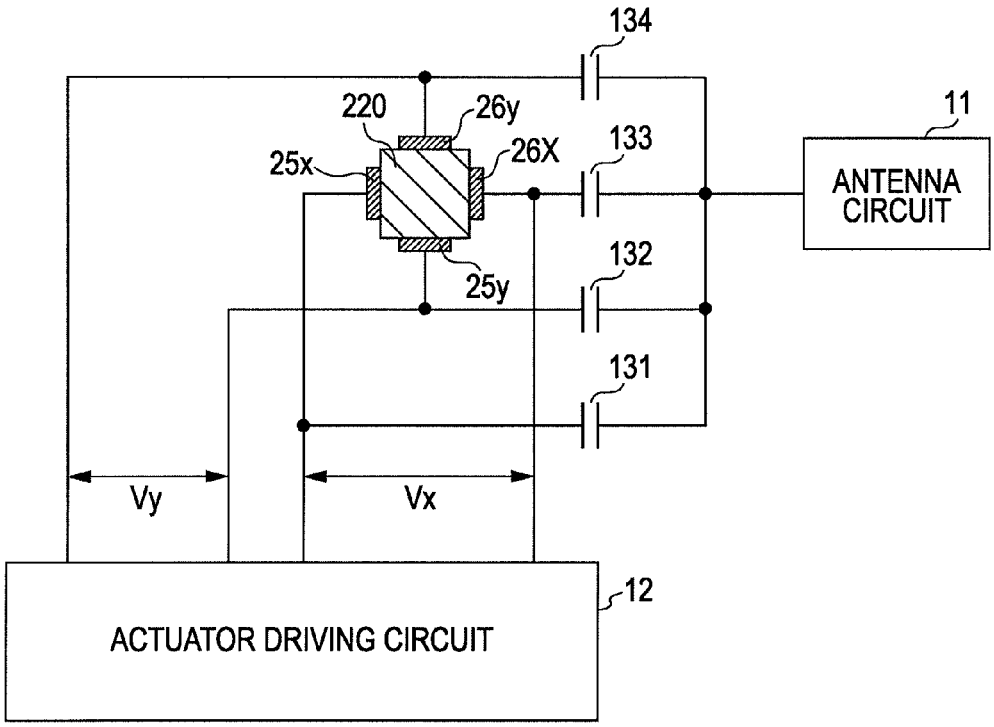
FIG. 19 is a diagram illustrating an antenna device according to another embodiment of the present invention.

FIG. 19 is a diagram illustrating an exemplary configuration of the main part of the actuator member 22 including four electrodes 25*x*, 25*y*, 26*x*, and 26*y*, all of which also serve as antenna conductors. In other words, as shown in FIG. 19, the electrodes 25*x*, 25*y*, 26*x*, and 26*y* are connected to one another through capacitors 131, 132, 133, and 134 and their connection points are connected to the antenna circuit 11.

In this case, as in the case with the aforementioned example, an actuator-driving control voltage Vx is supplied from the actuator drive circuit 12 to between the electrode 25*x* and the electrode 26*x*. In addition, an actuator-driving control voltage Vy is supplied from the actuator drive circuit 12 to between the electrode 25*y* and the electrode 26*y*.

Therefore, the actuator member 22 of the antenna device 2 is subjected to displacement control according the first example or the second example of the displacement control operation of the aforementioned antenna device 2. The displacement control allows the antenna conductor to be placed at an appropriate position in a manner similar to one described in the aforementioned embodiment.

Here, in the case of allowing the electrode of the actuator member 22 to also serve as the antenna conductor, the tip end of the ion conductive polymer streak 220 may be provided with a streak conductor electrically connected to the electrode. Consequently, the length of the antenna conductor can be adjusted.

<Second Modified Example of Antenna Device 2>

The example of antenna device 2 described above increases a streak antenna conductor 21 and an ion conductive polymer streak 220 which constitutes an actuator member 22. The streak antenna conductor 21 and the ion conductive polymer streak 220 are arranged in parallel with each other so that they can be integrally displaced together.

In contrast, in the second modified example, the antenna device 21 is connected to the actuator member 22 in the longitudinal direction thereof.

Figure 20A:
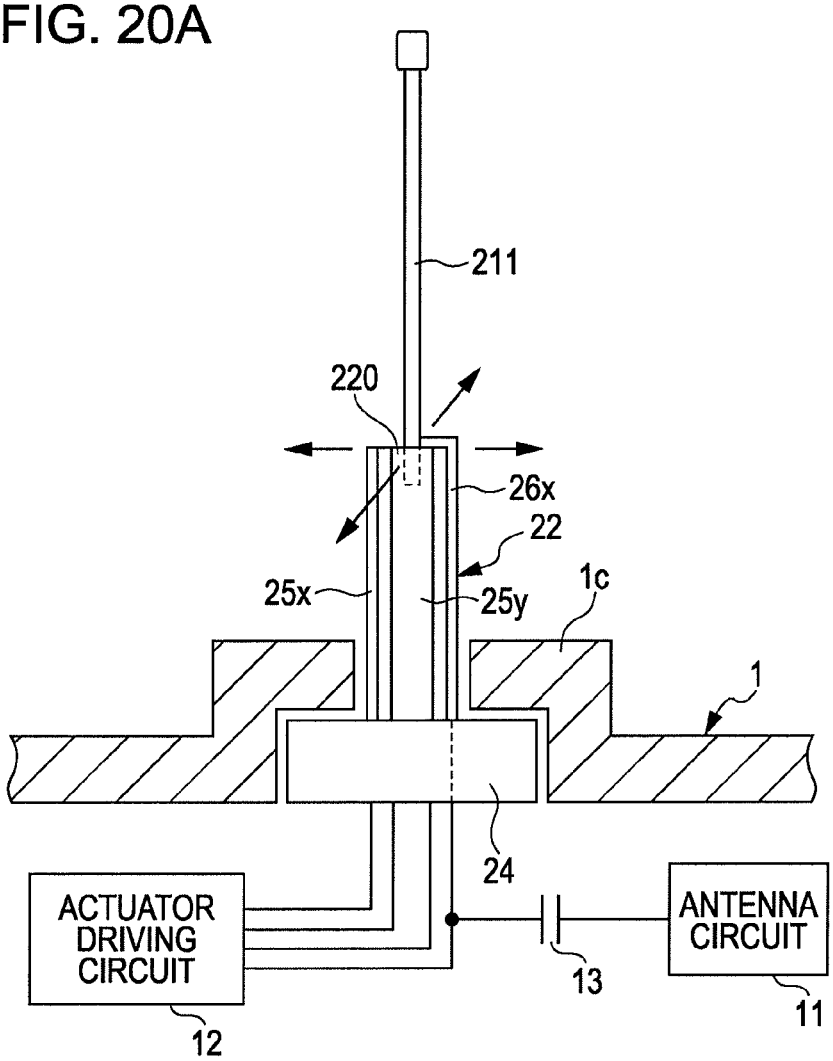
FIG. 20 is a diagram illustrating an antenna device according to another embodiment of the present invention.
Figure 20B:
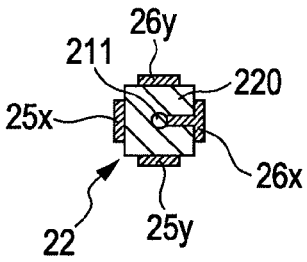

According to such a modified example, FIG. 20A is a diagram illustrating an exemplary configuration of the antenna device 2 and the related circuits in the insides of both the antenna device 2 and the cellular phone terminal 10. FIG. 20B is a diagram viewing from the upper side of the antenna device 2 in the longitudinal direction.

In the example shown in FIG. 20, an additional antenna conductor 211 is fixed on the tip end of the ion conductive polymer stream 220 in the longitudinal direction thereof. Here, the ion conductive polymer stream 220 is a structural part of the actuator member 22 having the same configuration as that of the antenna device 2 of the aforementioned embodiment shown in FIG. 1. In this example, the antenna conductor 211 may be made of a hard (non-flexible) metallic conductor. In other words, as shown in FIG. 20A, the longitudinal end of the antenna conductor 211 is fixedly connected to the longitudinal end of the actuator member 22.

Alternatively, for example, the longitudinal end of the antenna conductor 211 may be embedded in the ion conductive polymer streak 220 and bonded thereon to fix the antenna conductor 211 on the ion conductive polymer streak 220.

Therefore, in a manner similar to the aforementioned embodiment, the actuator member 22 can be controllably displaced in the directions represented by the arrows shown in FIG. 20A by application of actuator-driving control voltages Vx and Vy from the actuator drive circuit 12. Therefore, the antenna conductor 211 can be displaced depending on the displacement of the actuator member 22.

Furthermore, in the example shown in FIG. 20, the length of the ion conductive polymer streak 220 of the actuator member 22 is set to one enough to displace the antenna conductor 211 to a position suitable for communication while satisfying the criterion of local SAR when the user holds the cellular phone terminal 10 near the ear.

The length of the antenna conductor 211 is set to one enough to obtain a sufficient reception field strength in communication. In the example shown in FIG. 20, the antenna conductor 211 connected to the electrode 26*x* on the tip portion of the ion conductive polymer streak 220. In this example, therefore, the electrode 26*x* makes up part of the antenna conductor, so that the length of the antenna conductor includes the length of the electrode 26*x*. Furthermore, as shown in FIG. 20A, the electrode 26*x* is connected to the antenna circuit 11 through the capacitor 13.

In the example shown in FIG. 20, the electrode 26*x* makes up part of the antenna conductor 211. Alternatively, the end of the antenna conductor 211 at the connection with the ion conductive polymer streak 220 may be connected to the antenna circuit 11 through an antenna lead wire. In this case, the capacitor 13 is omissible.

As in the case with the aforementioned example, an actuator-driving control voltage Vx is supplied from the actuator drive circuit 12 to between the electrode 25*x* and the electrode 26*x* and an actuator-driving control voltage Vy is supplied from the actuator drive circuit 12 to between the electrode 25*y* and the electrode 26*y*.

Subsequently, the actuator member 22 of the antenna device 2 is controllably displaced according to the first example or the second example of the displacement control if the aforementioned antenna device 2. In a manner similar to the aforementioned embodiment, the antenna conductor can be controllably placed at an appropriate position.

In the above example, the antenna conductor 211 is made of a hard metallic conductor. Alternatively, it may be made of a flexible streak conductor.

<Third Modified Example of Antenna Device 2>

In the above example, the actuator member 22 includes electrically independent electrodes respectively formed on four sides of the ion conductive polymer streak 220 in the form of a square pole. Thus, the paired electrodes 25*x* and 26*x* and the paired electrodes 25*y* and 26*y* are formed, where actuator-driving control voltages Vx and Vy are applied to between each of these electrode pairs to cause three-dimensional displacement.

Alternatively, however, the ion conductive polymer streak to be displaced in the plane Sxz and the ion conductive polymer streak to be displaced in the plane Syz may be formed, independently, just as in the case of the following third modified example of the antenna device 2.

FIG. 21 is a diagram illustrating an exemplary configuration of the third modified example. In this example, the actuator member 22 includes two ion conductive polymer streaks 220Y and 220X instead of including one ion conductive polymer streak 220 of the example shown in FIG. 1.

Figure 21A:
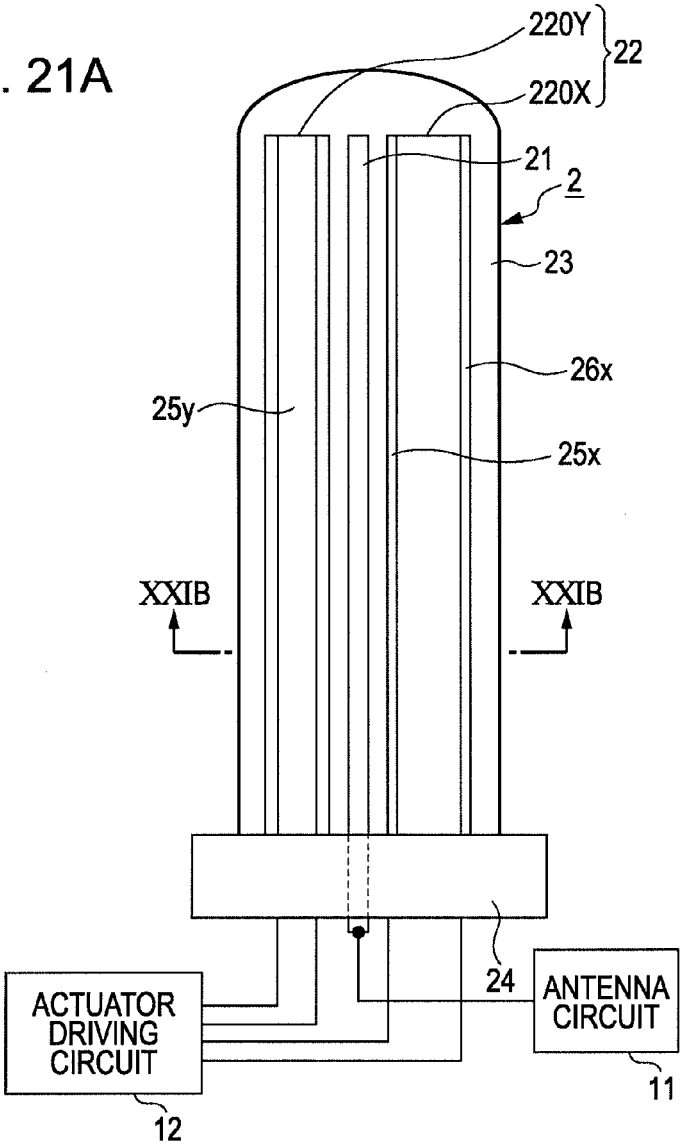
FIG. 21 is a diagram illustrating an antenna device according to another embodiment of the present invention.
Figure 21B:
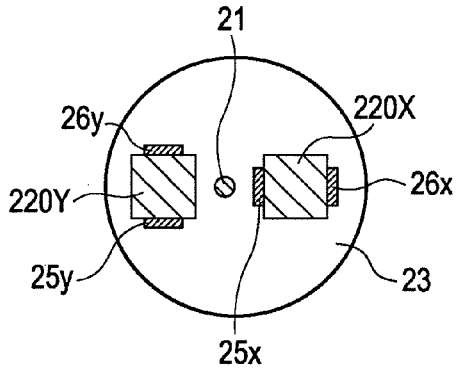

In this example, as shown in FIG. 21A and FIG. 21B, the antenna conductor 21 is placed between two ion conductive polymer streaks 220Y and 220X. Like the aforementioned example, the end of the antenna conductor 21 is connected to the antenna circuit 11. Then, the antenna conductor 21 and two ion conductive polymer streaks 220Y and 220X are entirely covered with the cover 23.

In addition, the paired electrodes 25*y* and 26*y* are formed on the opposite sides of the ion conductive polymer streak 220Y. The paired electrodes 25*x* and 26*x* are formed on the opposite sides of the ion conductive polymer streak 220X and arranged perpendicular to the paired electrodes 25*y* and 26*y*.

In the configuration of the antenna device 2 shown in FIG. 2, but not shown in the figure, an actuator-driving control voltage Vy is supplied from the actuator drive circuit 12 to the paired electrodes 25*y* and 26*y*. In addition, an actuator-driving control voltage Vx is supplied from the actuator drive circuit 12 to the paired electrodes 25*x* and 26*x*.

Therefore, also in this third modified example, the antenna conductor 21 can be controllably displaced by the actuator member 22 constructed of two ion conductive polymer streaks 220Y and 220X just as in the case with one described in the embodiment shown in FIG. 1.

In the third modified example, alternatively, the electrode of the actuator member 22 may be also used as an antenna conductor 21. In this case, the antenna conductor 21 may be constructed of one electrode selected from one of the electrode pairs in two ion conductive polymer streaks 220Y and 220X. Alternatively, the antenna conductor 21 may be constructed of two electrodes of one of these electrode pairs. Like the example shown in FIG. 19, the selected electrodes are connected to each other through a capacitor.

Alternatively, like the example shown in FIG. 19, all electrodes of two ion conductive polymer streaks 220Y and 220X are connected to one another through capacitors and the respective connection points are connected to the antenna circuit 11 to allow all of the electrodes of two ion conductive polymer streaks 220Y and 220X to be also used as antenna conductors.

In addition, the third modified embodiment may be combined with the modified example shown in FIG. 20. In this case, two ion conductive polymer streak 220Y and 220X are designed so that they can be integrally displaced while the antenna conductor 11 can be fixed on one of two ion conductive polymer streaks 220Y and 220X.

Furthermore, in this third modified example, only a pair of opposite electrodes is formed on each of the ion conductive polymer streaks 220Y and 220X. Thus, the longitudinal sides of the ion conductive polymer streaks 220Y and 220X form a space between the paired electrodes. Therefore, a streak conductor that forms an antenna conductor in parallel with the electrode can be easily formed by adhesion in the space of the ion conductive polymer streak 220Y or 220X.

Obviously, even in the case of forming two pairs of electrodes on the ion conductive polymer streak 220, an antenna conductor can be formed by adhesion on the side of the ion conductive polymer streak 220 in parallel with two pairs of electrodes wile being electrically unconnected to these two pairs of electrodes.

[Other Embodiment and Modified Example]

In the aforementioned example, to allow the actuator member 22 to be displaced in both the plane Sxz and the plane Syz which are perpendicular to each other, a pair of electrodes 25*x* and 26*y* and a pair of electrodes 25*y* and 26*y*, where the direction along which the electrodes face to each other in one of the pairs is perpendicular to that of the other, are formed on the actuator member 22.

However, according to any embodiment of the present invention, one electrode of the paired electrodes 25*x* and 26*x* or one electrode of the paired electrode 25*y* and 26*y* is formed on the ion conductive polymer streak to allow the actuator member 22 to be displaced in one of the plane Sxz and the plane Syz. In other words, in this embodiment, the actuator member 22 may be displaced only in one direction. However, just as in the case with the aforementioned embodiment, there is an advantage that the actuator member 2 may be displaced in two directions perpendicular to each other to displace the actuator member 22 in any direction in a three dimensional space.

In addition, the actuator member can be displaced in any of directions by providing the actuator member with two pairs of electrodes, where the direction along which the electrodes face to each other in one of the pairs is perpendicular to that of the other. To displace the actuator member in any direction more easily, the displacement of the actuator member may be controlled by the formation of two or more pairs of electrodes.

For example, the ion conductive polymer streak 220 in the actuator member 22 may be in the form of a hexagonal column and three pairs of electrodes may be formed on the respective sides of the hexagonal column. In this case, the displacement control of the actuator member 22 in the directions of the respective electrode pairs may be performed by controlling only DC voltage levels applied to the electrodes.

In this embodiment, furthermore, the first example and the second example of the displacement control of the antenna device 2 may be executed in combination. In the step S105 shown in FIG. 8, for example, the second example may be performed. In the step 114 shown in FIG. 9, the stepwise processing as described in the first example may be executed.

In the aforementioned example, furthermore, the actuator member 22 is in the form of a line and the tip thereof serves as a free end. Alternatively, however, the actuator member 22 may be formed as part of a ring-shaped strap. In this case, for example, the actuator member 22 may have a length of one half or less of the total length of the ring-shaped strap.

Furthermore, in the above description, the cellular phone terminal has been described as an example of the communication apparatus. According to any embodiment of the present invention, it is noted that the communication apparatus is not limited to a cellular phone terminal. For example, it is very useful when an antenna device is formed in the shape of a strap for a small radio receiver, a one-seg TV receiver, a transceiver, or a mobile terminal device with a wireless communication function.

Furthermore, in addition to the cellular phone terminal, any embodiment of the present embodiment is preferable in the case of a wireless communication terminal that makes communication with a transceiver or the like because SAR can be also considered.

The displacement control of the antenna conductor can be initiated not only by the aforementioned incoming phone call or outgoing phone call but also by power activation of the communication terminal or access of the housing of the communication apparatus to the human body.

By the way, SAR is an example of the index of the criteria for electromagnetic waves acceptable to the human body. If there is another index, it is noted that the actuator member can be controllably displaced so as to satisfy the criteria of electromagnetic waves acceptable to the human body based on the index.

Furthermore, the actuator member is not limited to the ion conductive polymer streak using ion-exchange resin as a raw material as described in the aforementioned example.

The present application contains subject matter related to that disclosed in Japanese Priority Patent Application JP 2009-279274 filed in the Japan Patent Office on Dec. 9, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An antenna device comprising:

a movable linear antenna conductor;

a rod-shaped actuator member that directly supports said movable linear antenna; and an attaching member that attaches said actuator member and said antenna conductor, and a drive controller for generating an actuator-driving control voltage to drive said actuator member with said control voltage to displace said actuator member wherein said one longitudinal end of said antenna conductor serves as a fixed support and the other end thereof serves as a free end to be displaceable relative to the communication apparatus in three-dimensional space in a direction and by an amount depending on said control voltage.

2. The antenna device according to claim 1, wherein said actuator member is in the form of a linear body, and electrodes to which said control voltage is applied are formed on said actuator member along said linear body, and at least one of said electrodes is also used as said antenna conductor.

3. The antenna device according to claim 1, wherein said control voltage is a DC voltage, said actuator member is displaced in a plane in a direction of an electric field generated by applying said control voltage, and two different kinds of said drive voltage are applied to said actuator member so that the directions of the generated electric fields are perpendicular to each other.

4. The antenna device according to claim 1, wherein said actuator member is a polymer actuator using ion-exchange resin.

5. A communication apparatus comprising:

a housing including a communication circuit and a control circuit; and an antenna device having a movable linear antenna conductor on the outside of and attachable to said housing, wherein said antenna device includes said antenna conductor, a rod-shaped actuator member that directly supports movable linear antenna, and an attaching member that attaches said actuator conductor and said antenna member, wherein said actuator member performs displacement control in which one longitudinal end of said antenna conductor serves as a fixed support and the other end thereof serves as a free end to be displaceable relative to the housing in three-dimensional space depending on said control voltage, and said control circuit includes a detection means that detects the strength of incoming electromagnetic waves received from the remote communication apparatus through said antenna conductor, and an actuator-driving means that generates said control voltage depending on said electromagnetic wave strength detected by said detection means, and supplies said control voltage to said actuator member to drive said actuator member to move said antenna conductor to a position to increase receiver sensitivity to incoming communication.

6. The communication apparatus according to claim 5, wherein said actuator member is a flexible linear body constructed of a polymer actuator using ion-exchange resin formed together with said antenna conductor in a strap shape.

7. A communication apparatus comprising:

a housing including a communication circuit and a control circuit; and an antenna device having a movable linear antenna conductor on the outside of and attachable to said housing, wherein said antenna device includes said antenna conductor, a rod-shaped actuator member that directly supports said movable linear antenna, and an attaching member that attaches said actuator member and said antenna conductor, wherein said actuator member performs displacement control in which one longitudinal end of said antenna conductor serves as a fixed support and the other end thereof serves as a free end to be displaceable relative to the housing in three-dimensional space depending on said control voltage, and said control circuit includes a communication-state detection means that detects when said communication function is executed, and an actuator-driving means that generates said control voltage when said communication-state detection means detects that said communication function is executed to drive said actuator member to keep said antenna conductor away from the head of the user so as to satisfy the criteria of the electromagnetic waves acceptable to the human body when the communication apparatus is held near the user's head.

8. The communication apparatus according to claim 7, wherein said control circuit includes a strength detection means that detects the strength of incoming electromagnetic waves received from the remote communication apparatus through said antenna conductor, and said actuator-driving means generates said control voltage depending on the strength of said electromagnetic waves detected by said strength detection means, and supplies said generated control voltage to said actuator member to bring said antenna conductor to a position with a high reception sensitivity to incoming communication while satisfying the criterion of the electromagnetic waves acceptable to said human body.

9. The communication apparatus according to claim7, wherein said communication function is telephone communication using a cellular phone to send or receive a call, and said communication-state detecting means detects an outgoing phone call and an incoming phone call.

10. The communication apparatus according to claim 7, wherein said actuator member is a flexible linear body constructed of a polymer actuator using ion-exchange resin formed together with said antenna conductor in a strap shape.

11. A communication apparatus comprising:

a housing including a communication circuit and a control circuit; and an antenna device having a movable linear antenna conductor on the outside of and attachable to said housing, wherein said antenna device includes said antenna conductor, a rod-shaped actuator member that directly supports said movable linear antenna, and an attaching member that attaches said actuator member and said antenna conductor, wherein said actuator member performs displacement control in which one longitudinal end of said antenna conductor serves as a fixed support and the other end thereof serves as a free end to be displaceable relative to the housing in three-dimensional space depending on said control voltage, and said control circuit includes a detection unit that detects the strength of incoming electromagnetic waves received from the remote communication apparatus through said antenna conductor, and an actuator-driving control unit that generates said control voltage depending on said electromagnetic wave strength detected by said detection unit, and supplies said control voltage to said actuator member to drive said actuator member to move said antenna conductor to a position to increase receiver sensitivity to incoming communication to incoming communication.

12. A communication apparatus comprising:

a housing including a communication circuit and a control circuit; and an antenna device having a movable linear antenna conductor on the outside of and attachable to said housing, said communication apparatus being held near a user's head to execute a communication function for sending or receiving a call, wherein said antenna device includes said antenna conductor, a rod-shaped actuator member that directly supports said movable linear antenna, and an attaching member that attaches said actuator member and said antenna conductor, wherein said actuator member performs displacement control in which one longitudinal end of said antenna conductor serves as a fixed support and the other end thereof serves as a free end to be displaceable relative to the housing in three-dimensional space depending on said control voltage, and said control circuit includes a communication-state detection unit that detects when said communication function is executed, and an actuator-driving control unit that generates said control voltage when said communication-state detection unit detects that said communication function is executed to drive said actuator member to keep said antenna conductor away from the head of the user so as to satisfy the criteria of electromagnetic waves acceptable to the human body when the communication apparatus is held near the user's head.

* * * * *